US012674613B2

(12) United States Patent
Yu et al.

(10) Patent No.: US 12,674,613 B2
(45) Date of Patent: Jul. 7, 2026

(54) REFRIGERATOR

(71) Applicant: SAMSUNG ELECTRONICS CO., LTD., Suwon-si (KR)

(72) Inventors: Jinhong Yu, Suwon-si (KR); Chanbin Park, Suwon-si (KR); Seyeun Chang, Suwon-si (KR); Deulre Min, Suwon-si (KR); Jungeun Seo, Suwon-si (KR); Jisick Hwang, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 134 days.

(21) Appl. No.: 18/805,923

(22) Filed: Aug. 15, 2024

(65) Prior Publication Data

US 2025/0123046 A1 Apr. 17, 2025

Related U.S. Application Data

(63) Continuation of application No. PCT/KR2024/011904, filed on Aug. 9, 2024.

(30) Foreign Application Priority Data

Oct. 12, 2023 (KR) ..... 10-2023-0136297

(51) Int. Cl.
*F25D 11/02* (2006.01)
*F25D 17/06* (2006.01)
(Continued)

(52) U.S. Cl.
CPC ..... *F25D 11/02* (2013.01); *F25D 17/065* (2013.01); *F25D 23/12* (2013.01); *F25D 31/005* (2013.01);
(Continued)

(58) Field of Classification Search
CPC ..... F25D 11/02; F25D 17/065; F25D 23/12; F25D 25/025; F25D 31/005; F25D 2300/00; F25D 2317/061; F25D 2400/02
See application file for complete search history.

(56) References Cited

U.S. PATENT DOCUMENTS 8,028,538 B2 * 10/2011 Kim ..... F25D 17/08 62/187
9,109,819 B2 * 8/2015 Shin ..... F25B 21/02
(Continued)

FOREIGN PATENT DOCUMENTS

CN 114427774 A * 5/2002 ..... F25D 17/045
CN 209897305 U * 1/2020 ..... F25D 29/00
(Continued)

OTHER PUBLICATIONS

Translation JP2020051654A (Year: 2020).*
(Continued)

*Primary Examiner* — Andrew Roersma
(74) *Attorney, Agent, or Firm* — STAAS & HALSEY LLP

(57) ABSTRACT

A refrigerator may include an inner case that forms a storage compartment, a duct facing along a rear wall of the inner case and configured to guide cold air into the storage compartment, a temperature control compartment within the storage compartment, the temperature control compartment to have a temperature independent of a temperature of the storage compartment, and a heating assembly configured to control the temperature of the temperature control compartment, the heating assembly including a heater, a connector configured to supply power to the heater and mountable on the duct so as to face the rear wall of the inner case, and a heater case accommodating the heater and configured to cover the connector mounted on the duct so that with the
(Continued)

connector mounted on the duct, moisture which flows or condenses on the duct is prevented and/or reduced from entering the connector.

15 Claims, 19 Drawing Sheets

(51) Int. Cl.
*F25D 23/12* (2006.01)
*F25D 31/00* (2006.01)

(52) U.S. Cl.
CPC .... *F25D 2317/061* (2013.01); *F25D 2400/02* (2013.01)

(56) References Cited

U.S. PATENT DOCUMENTS

| | | | | |
|---|---|---|---|---|
| 10,718,552 | B2 * | 7/2020 | Park | F25D 23/028 |
| 11,300,348 | B2 | 4/2022 | Park et al. | |
| 11,596,159 | B2 | 3/2023 | Park et al. | |
| 12,449,193 | B2 * | 10/2025 | Choi | F25D 23/12 |
| 2014/0290302 | A1 * | 10/2014 | Shin | F25D 11/022 62/419 |
| 2018/0120014 | A1 | 5/2018 | Lee | |
| 2018/0187946 | A1 * | 7/2018 | Park | F25D 17/065 |
| 2021/0396450 | A1 * | 12/2021 | Yu | F25D 17/065 |
| 2022/0275993 | A1 | 9/2022 | Yoon et al. | |
| 2023/0204275 | A1 * | 6/2023 | Lee | F25D 23/06 62/56 |
| 2023/0304730 | A1 * | 9/2023 | Choi | F25D 11/02 |
| 2024/0019190 | A1 * | 1/2024 | Choi | F25D 31/005 |
| 2024/0344765 | A1 * | 10/2024 | Min | F25D 17/065 |

FOREIGN PATENT DOCUMENTS

| | | | | |
|---|---|---|---|---|
| CN | 112747527 | A * | 5/2021 | F25D 23/12 |
| CN | 216897975 | U * | 7/2022 | A23B 2/00 |
| CN | 216897976 | U | 7/2022 | |
| CN | 116412608 | A | 7/2023 | |
| JP | 2020-051654 | | 4/2020 | |
| KR | 100682665 | B1 * | 2/2007 | F25D 31/005 |
| KR | 10-1098623 | B1 | 12/2011 | |
| KR | 10-1734784 | B1 | 5/2017 | |
| KR | 10-2018-0124451 | | 11/2018 | |
| KR | 10-2021-0080197 | A | 6/2021 | |
| KR | 10-2421447 | B1 | 7/2022 | |
| KR | 10-2548435 | B1 | 6/2023 | |
| KR | 10-2023-0116517 | A | 8/2023 | |
| WO | WO-2023146113 | A1 * | 8/2023 | F25D 31/005 |

OTHER PUBLICATIONS

International Search Report dated Dec. 3, 2024 for International application No. PCT/KR2024/011904.
Written Opinion of the International Searching Authority dated Dec. 3, 2024 for International application No. PCT/KR2024/011904.

* cited by examiner

REFRIGERATOR

CROSS-REFERENCE TO RELATED APPLICATIONS

This is a continuation application, under 35 U.S.C. § 111(a), of International Application No. PCT/KR2024/011904, filed Aug. 9, 2024, which claims priority under 35 U.S.C. § 119 to [Korean] Patent Application No. 10-2023-0136297, filed Oct. 12, 2023, in the Korean Intellectual Property Office, the disclosures of which are incorporated herein in their entireties by reference.

TECHNICAL FIELD

The disclosure relates to refrigerators with an improved structure.

BACKGROUND ART

A refrigerator, an appliance for keeping food fresh, includes a storage compartment for storing food and a cold air supply device for supplying cold air to the storage compartment. The storage compartment includes a refrigerating compartment in which the food is kept refrigerated at a temperature of about 0° C. to 5° C., and a freezing compartment in which the food is kept frozen at a temperature of about 0° C. to −30° C.

Such a refrigerator may be classified based on the location of the refrigerating and freezing compartments and the shape of the doors. In other words, the refrigerator may be classified into a bottom-mounted freezer (BMF) type, in which the refrigerating compartment is located at the top and the freezing compartment is located at the bottom, a top-mounted freezer (TMF) type, in which the refrigerating compartment is located at the bottom and the freezing compartment is located at the top; and a side-by-side (SBS) type, in which the freezing compartment is located at the left and the refrigerating compartment is located at the right. In addition, the BMF type refrigerator includes a French door refrigerator (FDR) type, which has a pair of refrigerating compartment doors to open and close the refrigerating compartment, and a 4-door type, which has a pair of refrigerating compartment doors to open and close the refrigerating compartment and a pair of freezing compartment doors to open and close the freezing compartment.

The refrigerator may include a temperature control compartment in which an internal temperature may be controlled to have an internal temperature different from the temperature of the storage compartment.

SUMMARY

An embodiment of the present disclosure provides a refrigerator including a heating assembly having an improved structure.

An embodiment of the present disclosure provides a refrigerator including a detachable heating assembly.

An embodiment of the present disclosure provides a refrigerator capable of preventing and/or reducing moisture from entering an interior of a heating assembly without the need for a separate gasket.

An embodiment of the present disclosure provides a refrigerator with improved heating efficiency.

An embodiment of the present disclosure provides a refrigerator with improved safety of use.

An embodiment of the present disclosure provides a refrigerator with improved ease of use.

Technical tasks to be achieved in this document are not limited to the technical tasks mentioned above, and other technical tasks not mentioned will be clearly understood by those skilled in the art from the description below.

According to an embodiment of the present disclosure, a refrigerator may include an inner case that forms a storage compartment; a duct facing along a rear wall of the inner case and configured to guide cold air into the storage compartment; a temperature control compartment within the storage compartment, the temperature control compartment to have a temperature independent of a temperature of the storage compartment; and a heating assembly configured to control the temperature of the temperature control compartment, the heating assembly including a heater, a connector configured to supply power to the heater and mountable on the duct so as to face the rear wall of the inner case, and a heater case accommodating the heater and configured to cover the connector mounted on the duct so that with the connector mounted on the duct moisture which flows or condenses on the duct is prevented and/or reduced from entering the connector.

The heater case may be detachably couplable to a lower wall of the inner case and a front side of the duct.

The heater case may include: a lower frame configured to sit on the lower wall of the inner case, and an upper frame detachably couplable to the lower frame.

The upper frame may include: a body portion configured to support a lower portion of the temperature control compartment, and a cover portion extending upwardly from a rear side of the body portion so that with the connector mounted on the duct, the cover portion covers the connector.

The heater may be attached to an upper inner surface of the upper frame, and the lower frame may include a protrusion protruding upwardly and supporting the heater so that with the upper frame detachably coupled to the lower frame, the heater and the upper frame are in close contact.

The refrigerator may further include a guide rib that protrudes from a front side of the duct, and with the connector mounted on the duct, the guide rib may be above the connector to guide the moisture downward.

The guide rib may be inclined downwardly toward a side wall of the inner case.

The refrigerator may further include: a drawer case to form the temperature control compartment, and a drawer configured to be inserted into and withdrawn from the drawer case.

The drawer case may be detachably couplable to the heater case.

The refrigerator may further include a drawer case to form the temperature control compartment and a drawer configured to be inserted into and withdrawn from the drawer case, and wherein the drawer case includes a locking protrusion protruding from a lower surface of the drawer case, and the upper frame includes a locking groove in the body portion to correspond to the locking protrusion so that with the drawer inserted into the drawer case, the locking protrusion is accommodated in the locking groove and movement of the drawer in at least one of a forward direction and a backward direction is restricted.

The refrigerator may further include a drawer case to form the temperature control compartment and a drawer configured to be inserted into and withdrawn from the drawer case, and wherein the drawer case includes a locking protrusion protruding from a rear surface of the drawer case, and the upper frame includes an interference portion on the cover portion that is configured to interfere with an upper side of the locking protrusion so that with the drawer inserted into the drawer case, the interference portion interferes with the upper side of the locking protrusion and an upward movement of the drawer case is restricted.

The upper frame may include: a first sealing protrusion protruding downwardly from an edge of the upper frame, a second sealing protrusion spaced apart from the first sealing protrusion and protruding downwardly from a body portion of the upper frame so that a sealing groove is formed between the first sealing protrusion and the second sealing protrusion, and the lower frame may include: a third sealing protrusion protruding upwardly from an edge of the lower frame so that with the upper frame detachably coupled to the lower frame, the third sealing protrusion is accommodated in the sealing groove.

The lower frame may include a hook protruding from the third sealing protrusion, and the upper frame may include a hook hole formed in the first sealing protrusion and configured to correspond to the hook so that with the upper frame detachably coupled to the lower frame, the hook is inserted into the hook hole.

The duct may include a connector hole so that with the connector mounted on the duct, the connector is insertable into the connector hole.

The refrigerator may further include a controller configured to control an operation of the heater, wherein, with the connector mounted on the duct, the connector is electrically connected to the controller.

According to an embodiment of the present disclosure, a refrigerator includes an inner case forming a storage compartment, a temperature control compartment disposed within the storage compartment and configured to have a temperature independent of the storage compartment, and a heating assembly configured to heat a lower portion of the temperature control compartment. The heating assembly may include an upper frame, a heater mounted on an upper inner surface of the upper frame, and a lower frame detachably couplable to the upper frame. The lower frame may include a protrusion contactable with the heater to prevent and/or reduce the heater from being separated from the upper frame.

MODES OF THE INVENTION

Figure 1:
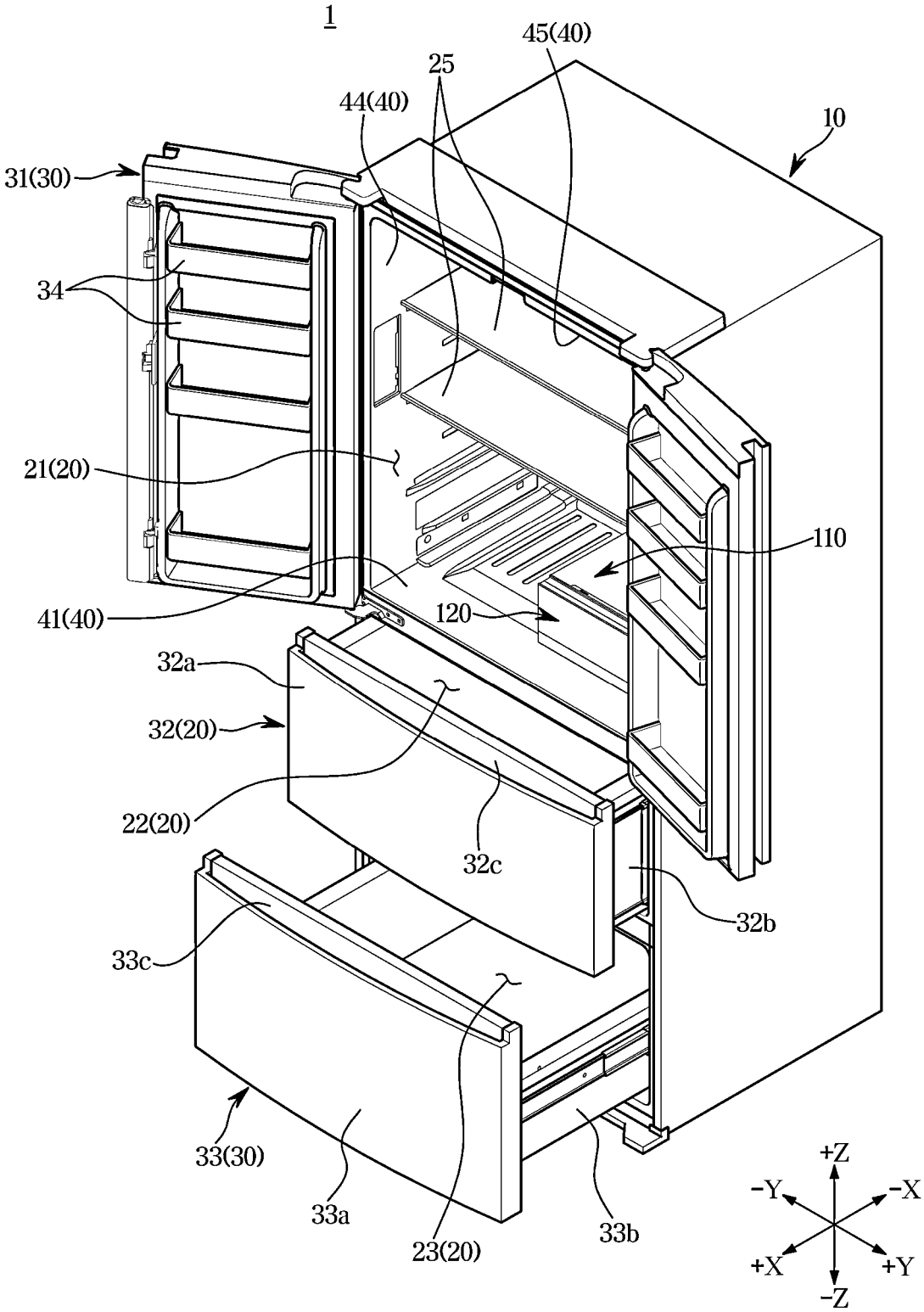
FIG. 1 is a perspective view schematically illustrating a refrigerator according to an embodiment.

Various embodiments of the present document and terms used therein are not intended to limit the technical features described in this document to specific embodiments, and should be understood to include various modifications, equivalents, or substitutes of the corresponding embodiments.

In connection with the description of the drawings, similar reference numerals may be used for similar or related components.

The singular form of a noun corresponding to an item may include one or a plurality of the items unless clearly indicated otherwise in a related context.

In this document, phrases, such as "A or B", "at least one of A and B", "at least one of A or B," "A, B or C," "at least one of A, B and C," and "at least one of A, B, or C", may include any one or all possible combinations of items listed together in the corresponding phrase among the phrases.

As used herein, the term "and/or" includes any and all combinations of one or more of associated listed items.

The term "part", "portion", "module", or "member" may be implemented in hardware or software. In some embodiments, a plurality of "parts", "portions", "modules", or "members" may be implemented as a single component, or a single "part", "portion", "module", or "member" may comprise a plurality of components.

Terms such as "1st", "2nd", "primary" or "secondary" may be used simply to distinguish a component from other components, without limiting the component in other aspects (e.g., importance or order).

When a component (e.g., a first component) is referred to as "coupled" or "connected" to another component (e.g., a second component), with or without the terms "functionally" or "communicatively," it may refer to that the component may be connected to another component directly (e.g., wired), wirelessly, or through a third component.

It will be understood that when the terms "includes," "comprises," "including," and/or "comprising," when used in this specification, specify the presence of stated features, figures, steps, operations, components, members, or combinations thereof, but do not preclude the presence or addition of one or more other features, figures, steps, operations, components, members, or combinations thereof.

It will be understood that when a certain component is referred to as being "connected to", "coupled to", "supported by" or "in contact with" another component, it can be directly or indirectly connected to, coupled to, supported by, or in contact with the other component. When a component is indirectly connected to, coupled to, supported by, or in contact with another component, it may be connected to, coupled to, supported by, or in contact with the other component through a third component.

It will also be understood that when a component is referred to as being "on" or "over" another component, it can be directly on the other component or intervening components may also be present.

A refrigerator according to an embodiment of the disclosure may include a main body.

The "main body" may include an inner case, an outer case positioned outside the inner case, and an insulation provided between the inner case and the outer case.

The "inner case" may include a case, a plate, a panel, or a liner forming a storage compartment (also referred to as a storage room). The inner case may be formed as one body, or may be formed by assembling a plurality of plates together. The "outer case" may form an appearance of the main body, and be coupled to an outer side of the inner case such that the insulation is positioned between the inner case and the outer case.

The "insulation" may insulate inside of the storage compartment from outside of the storage compartment to maintain inside temperature of the storage compartment at appropriate temperature without being influenced by an external environment of the storage compartment. According to an embodiment of the disclosure, the insulation may include a foaming insulation. The foaming insulation may be molded by fixing the inner case and the outer case with jigs, etc. and then injecting and foaming urethane foam as a mixture of polyurethane and a foaming agent between the inner case and the outer case.

According to an embodiment of the disclosure, the insulation may include a vacuum insulation in addition to a foaming insulation, or may be configured only with a vacuum insulation instead of a forming insulation. The vacuum insulation may include a core material and a cladding material accommodating the core material and sealing the inside with vacuum or pressure close to vacuum. The vacuum insulation may further include an adsorbent for adsorbing a gas and water to stably maintain a vacuum state. However, the insulation is not limited to the above-mentioned foaming insulation or vacuum insulation, and may include various materials capable of being used for insulation.

The "storage compartment (storage room)" may include a space defined by the inner case. The storage compartment may further include the inner case defining the space. A variety of items, such as food, medicine, and cosmetics, may be stored in the storage compartment, and at least one side of the storage compartment may be open for putting items or taking items out.

The refrigerator may include one or more storage compartments. In a case in which two or more storage compartments are formed in the refrigerator, the respective storage compartments may have different purposes of use, and may be maintained at different temperature. To this end, the storage compartments may be partitioned by a partition wall including an insulation.

The storage compartment may be maintained within an appropriate temperature range according to a purpose of use, and include a "refrigerating compartment", a "freezing compartment", and a "temperature conversion compartment" according to purposes of use and/or temperature ranges. The refrigerating compartment may be maintained at appropriate temperature to keep food refrigerating, and the freezing compartment may be maintained at appropriate temperature to keep food frozen. The "refrigerating" may be keeping food cold without freezing the food, and for example, the refrigerating compartment may be maintained within a range of 0 degrees Celsius to 7 degrees Celsius. The "freezing" may be freezing food or keeping food frozen, and for example, the freezing compartment may be maintained within a range of −20 degrees Celsius to −1 degrees Celsius. The temperature conversion compartment may be used as any one of a refrigerating compartment or a freezing compartment according to or regardless of a user's selection.

The storage compartment may also be called various other terms, such as "vegetable compartment", "freshness compartment", "cooling compartment", and "ice-making compartment", in addition to "refrigerating compartment", "freezing compartment", and "temperature conversion compartment", and the terms, such as "refrigerating compartment", "freezing compartment", "temperature conversion compartment", etc., as used below need to be understood to represent storage compartments having the corresponding purposes of use and the corresponding temperature ranges.

The refrigerator according to an embodiment of the disclosure may include at least one door configured to open or close the open side of the storage compartment. The respective doors may be provided to open and close one or more storage compartments, or a single door may be provided to open and close a plurality of storage compartments. The door may be rotatably or slidably mounted on the front of the main body.

The "door" may seal the storage compartment in a closed state. The door may include an insulation, like the main body, to insulate the storage compartment in the closed state.

According to an embodiment, the door may include an outer door plate forming the front surface of the door, an inner door plate forming the rear surface of the door and facing the storage compartment, an upper cap, a lower cap, and a door insulation provided therein.

A gasket may be provided on the edge of the inner door plate to seal the storage compartment by coming into close contact with the front surface of the main body when the door is closed. The inner door plate may include a dyke that protrudes rearward to allow a door basket for storing items to be fitted.

According to an embodiment, the door may include a door body and a front panel that is detachably coupled to the front of the door body and forms the front surface of the door. The door body may include an outer door plate that forms the front surface of the door body, an inner door plate that forms the rear surface of the door body and faces the storage compartment, an upper cap, a lower cap, and a door insulator provided therein.

The refrigerator may be classified as French Door Type, Side-by-side Type, Bottom Mounted Freezer (BMF), Top Mounted Freezer (TMF), or One Door Refrigerator depending on the arrangement of the doors and the storage compartments.

The refrigerator according to an embodiment of the disclosure may include a cold air supply device for supplying cold air to the storage compartment.

The "cold air supply device" may include a machine, an apparatus, an electronic device, and/or a combination system thereof, capable of generating cold air and guiding the cool air to cool the storage compartment.

According to an embodiment of the disclosure, the cold air supply device may generate cold air through a cooling cycle including compression, condensation, expansion, and evaporation processes of refrigerants. To this end, the cold air supply device may include a cooling cycle device having a compressor, a condenser, an expander, and an evaporator to drive the cooling cycle. According to an embodiment of the disclosure, the cold air supply device may include a semiconductor such as a thermoelectric element. The thermoelectric element may cool the storage compartment by heating and cooling actions through the Peltier effect.

The refrigerator according to an embodiment of the disclosure may include a machine compartment where at least some components belonging to the cold air supply device are installed.

The "machine compartment" may be partitioned and insulated from the storage compartment to prevent heat generated from the components installed in the machine compartment from being transferred to the storage compartment. To dissipate heat from the components installed inside the machine compartment, the machine compartment may communicate with outside of the main body.

The refrigerator according to an embodiment of the disclosure may include a dispenser provided on the door to provide water and/or ice. The dispenser may be provided on the door to allow access by the user without opening the door.

The refrigerator according to an embodiment of the disclosure may include an ice-making device that produces ice. The ice-making device may include an ice-making tray that stores water, an ice-moving device that separates ice from the ice-making tray, and an ice-bucket that stores ice generated in the ice-making tray.

The refrigerator according to an embodiment of the disclosure may include a controller for controlling the refrigerator.

The "controller" may include a memory for storing and/or memorizing data and/or programs for controlling the refrigerator, and a processor for outputting control signals for controlling the cold air supply device, etc. according to the programs and/or data memorized in the memory.

The memory may store or record various information, data, commands, programs, and the like necessary for operations of the refrigerator. The memory may store temporary data generated while generating control signals for controlling components included in the refrigerator. The memory may include at least one of volatile memory or non-volatile memory, or a combination thereof.

The processor may control the overall operation of the refrigerator. The processor may control the components of the refrigerator by executing programs stored in memory. The processor may include a separate neural processing unit (NPU) that performs an operation of an artificial intelligence (AI) model. In addition, the processor may include a central processing unit (CPU), a graphics processor (GPU), and the like. The processor may generate a control signal to control the operation of the cold air supply device. For example, the processor may receive temperature information of the storage compartment from a temperature sensor, and generate a cooling control signal for controlling an operation of the cold air supply device based on the temperature information of the storage compartment.

Furthermore, the processor may process a user input of a user interface and control an operation of the user interface according to the programs and/or data memorized/stored in the memory. The user interface may be provided using an input interface and an output interface. The processor may receive the user input from the user interface. In addition, the processor may transmit a display control signal and image data for displaying an image on the user interface to the user interface in response to the user input.

The processor and memory may be provided integrally or may be provided separately. The processor may include one or more processors. For example, the processor may include a main processor and at least one sub-processor. The memory may include one or more memories.

The refrigerator according to an embodiment of the disclosure may include a processor and a memory for controlling all the components included in the refrigerator, and may include a plurality of processors and a plurality of memories for individually controlling the components of the refrigerator. For example, the refrigerator may include a processor and a memory for controlling the operation of the cold air supply device according to an output of the temperature sensor. In addition, the refrigerator may be separately equipped with a processor and a memory for controlling the operation of the user interface according to the user input.

A communication module may communicate with external devices, such as servers, mobile devices, and other home appliances via a nearby access point (AP). The AP may connect a local area network (LAN) to which a refrigerator or a user device is connected to a wide area network (WAN) to which a server is connected. The refrigerator or the user device may be connected to the server via the WAN.

The input interface may include keys, a touch screen, a microphone, and the like. The input interface may receive the user input and pass the received user input to the processor.

The output interface may include a display, a speaker, and the like. The output interface may output various notifications, messages, information, and the like generated by the processor.

The terms "front," "rear," "left", "right", "up", "down" and the like used in the following description may be defined with reference to the drawings, and the shape and position of each element are not limited by these terms. For example, with reference to the drawings, a side (front side) facing a door 30 of a refrigerator 1 may be defined as a +X side, and a side (rear side) opposite thereto may be defined as a −X side. For example, with reference to the drawings, a right side may be defined as a +Y side and a left side may be defined as a −Y side. For example, with reference to the drawings, an upper side may be defined as a +Z side and a lower side may be defined as a −Z side.

Hereinafter, various embodiments according to the disclosure will be described in detail with reference to the accompanying drawings.

Figure 2:
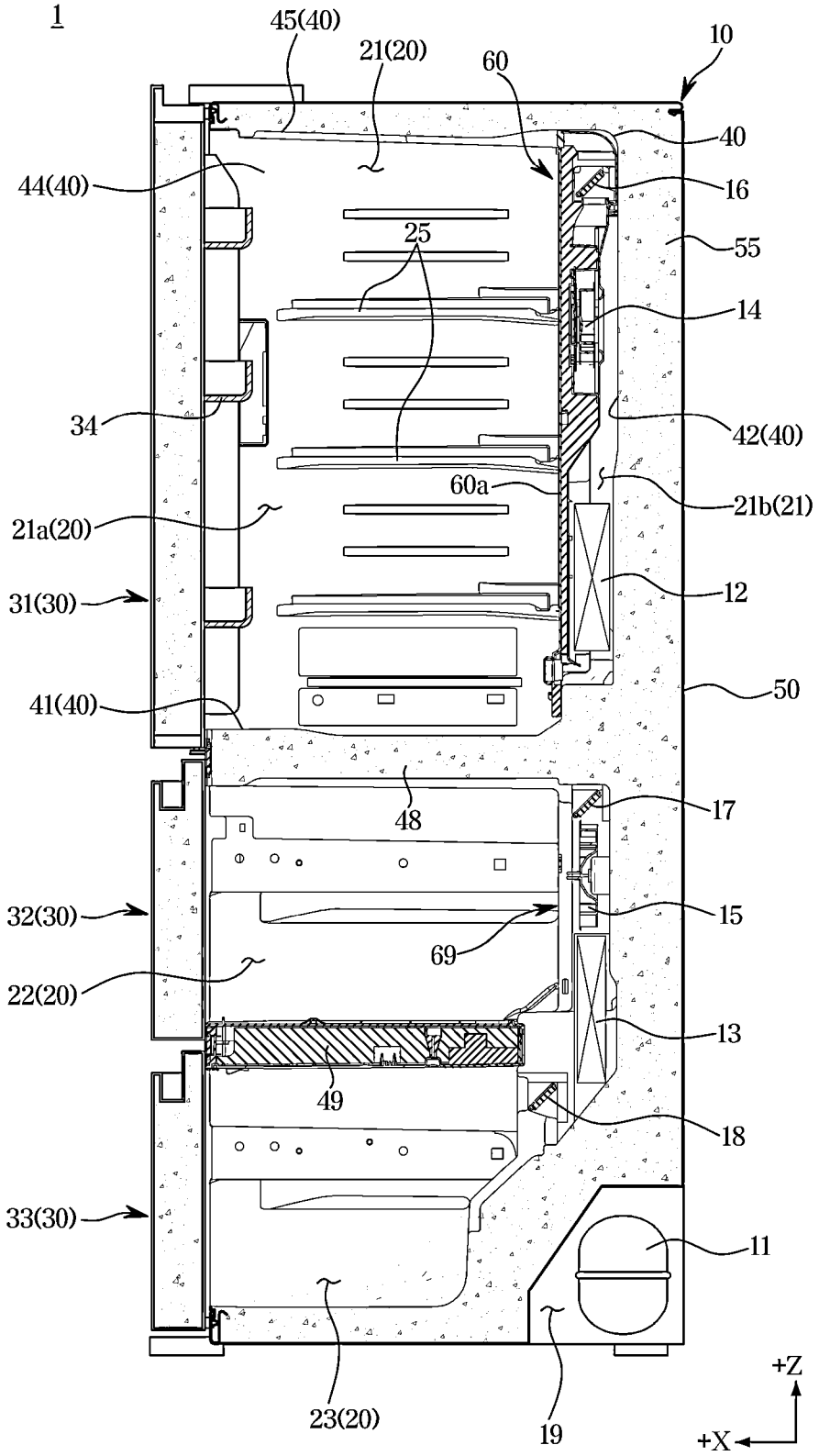
FIG. 2 is a side cross-sectional view schematically illustrating the refrigerator according to an embodiment.

FIG. 1 is a perspective view schematically illustrating a refrigerator according to an embodiment. FIG. 2 is a side cross-sectional view schematically illustrating the refrigerator according to an embodiment.

Referring to FIGS. 1 and 2, the refrigerator 1 may include a main body 10. The refrigerator 1 may include a storage compartment 20 provided within the main body 10.

The refrigerator 1 may include an inner case 40. The main body 10 may include the inner case 40 forming the storage compartment 20. The inner case 40 may be configured to include a plastic material. For example, the inner case 40 may be manufactured by a vacuum forming process. For example, the inner case 40 may be manufactured by an injection molding process.

The refrigerator 1 may include an outer case 50. The main body 10 may include an outer case 50 provided on an outside of the inner case 40. The outer case 50 may form at least a portion of the exterior of the refrigerator 1. The outer case 50 may also be referred to as a cabinet 50. The outer case 50 may be configured to include a metallic material. For example, the outer case 50 may be manufactured by machining a steel plate material.

The refrigerator 1 may include an insulation 55. The main body 10 may include an insulation 55 provided between the inner case 40 and the outer case 50. The insulation 55 may thermally insulate between the inner case 40 and the outer case 50. The insulation material 55 may prevent heat exchange between the inner case 40 and the outer case 50. For example, urethane foam insulation, expanded polystyrene insulation, vacuum insulation panel, and the like. may be used as the insulation 55. However, the present disclosure is not limited to the above examples, and the insulation 55 may be formed from a variety of materials.

The refrigerator 1 may include the storage compartment 20. The main body 10 may include the storage compartment 20 formed by the inner case 40. The storage compartment 20 may be used as a refrigerating compartment for keeping food items refrigerated by being maintained at about 0 to 5 degrees Celsius, or as a freezing compartment for keeping food items frozen at by being maintained at about-30 to 0 degrees Celsius.

The storage compartment 20 may be open at a front side to allow food to be stored or removed.

The storage compartment 20 may be provided with shelves 25 on which food may be placed. The storage compartment 20 may be provided with a storage container (not shown) to store food. The arrangement of the shelves 25 and/or the storage containers may be varied according to the desires of a user.

The refrigerator 1 may include at least one storage compartment 20. For example, the refrigerator 1 may include a first storage compartment 21, a second storage compartment 22, and a third storage compartment 23. In the drawings, the refrigerator 1 is shown as including three storage compartments 21, 22, and 23 divided into upper and lower portions, but the present disclosure is not limited thereto. For example, the refrigerator 1 may include two or fewer storage compartments, or may include four or more storage compartments. For example, the refrigerator 1 may include at least two storage compartments divided into the left and the right. For example, the refrigerator 1 may include one storage compartment. It should be understood that the refrigerator 1 may include the storage compartment 20 having different shapes and/or arrangements in addition to the examples described above.

An intermediate wall 48 may be provided between the first storage compartment 21 and the second storage compartment 22. A partition 49 may be provided between the second storage compartment 22 and the third storage compartment 23. For example, the intermediate wall 48 may be provided as a part of the inner case 40, and the partition 49 may be removably arranged to the inner case 40 in a configuration separate from the inner case 40. However, the present disclosure is not limited to the examples described above. Various known configurations and/or arrangements may be applied to the refrigerator 1 according to the present disclosure to partition the plurality of storage compartments.

The refrigerator 1 may include a door 30 provided to open or close the storage compartment 20. The door 30 may form a part of the exterior of the refrigerator 1. The door 30 may form a front exterior of the refrigerator 1.

The refrigerator 1 may include at least one door 30. For example, the refrigerator 1 may include a first door 31 to open or close the first storage compartment 21. For example, the refrigerator 1 may include a second door 32 to open or close the second storage compartment 22. For example, the refrigerator 1 may include a third door 33 to open or close the third storage compartment 23. In the drawings, the refrigerator 1 is shown as including three doors 31, 32, and 33, but the present disclosure is not limited thereto. For example, the number of doors 30 may correspond to the number of storage compartments 20. For example, the single door 30 may be arranged to open or close the plurality of storage compartments 20.

The first door 31 may be coupled to the main body 10 so as to be rotatable in a left-and-right direction. For example, door guards 34 for storing food may be provided on a rear surface of the first door 31.

The second door 32 may be slidably provided to move into or out of the second storage compartment 22. The second door 32 may include a door panel 32*a* covering an open front of the second storage compartment 22, and a basket 32*b* coupled to a rear surface of the door panel 32*a*. A handle 32*c* may be provided on the door panel 32*a*.

The third door 33 may be slidably provided to move into or out of the third storage compartment 23. The third door 33 may include a door panel 33*a* covering an open front of the third storage compartment 23 and a basket 33*b* coupled to a rear surface of the door panel 33*a*. A handle 33*c* may be provided on the door panel 33*a*.

The refrigerator 1 may include a cold air supply device that generates cold air using a cooling cycle and supplies the generated cold air to the storage compartment 20. The refrigerator 1 may include a compressor 11, a condenser, an expander, and evaporators 12 and 13. The refrigerator 1 may include blowing fans 14 and 15 that moves cold air generated by the evaporators 12 and 13. The evaporators 12 and 13 may be referred to as heat exchangers 12 and 13. The compressor 11, the condenser, or the like may be arranged in a machine compartment 19.

The refrigerator 1 may include the first evaporator 12 and the second evaporator 13. The first evaporator 12 may be provided to cool the air recovered from the first storage compartment 21. The first evaporator 12 may be provided to generate the cold air supplied to the first storage compartment 21. The second evaporator 13 may be provided to cool the air recovered from the second storage compartment 22 and the third storage compartment 23. The second evaporator 13 may be provided to generate the cold air supplied to the second storage compartment 22 and the third storage compartment 23.

The refrigerator 1 may include the first blowing fan 14 and the second blowing fan 15. The first blowing fan 14 may be provided to flow the cold air generated by the first evaporator 12. The second blowing fan 15 may be provided to flow the cold air generated by the second evaporator 13.

The refrigerator 1 may include a first damper 16, a second damper 17, and a third damper 18. The first damper 16 may regulate the amount of cold air supplied to the first storage compartment 21. The second damper 17 may regulate the amount of cold air supplied to the second storage compartment 22. The third damper 18 may regulate the amount of cold air supplied to the third storage compartment 23.

The refrigerator 1 may include a first duct 60 provided to guide cold air to the first storage compartment 21. The first duct 60 may guide the cold air generated by the first evaporator 12 to the first storage compartment 21. The first duct 60 may be arranged to face a rear wall 42 of the inner case 40. The first duct 60 may be disposed in a rear portion of the first storage compartment 21. The first duct 60 may be disposed on a rear side of a temperature control compartment 100, which will be described later. The first duct 60 may accommodate the first blowing fan 14 and the first damper 16. The first duct 60 may be provided to divide the first storage compartment 21 into a storage space 21*a* where food and the like is stored, and a cooling space 21*b* where the first evaporator 12 is disposed. The storage space 21*a* may be provided on a front side of the first duct 60, and the cooling space 21*b* may be provided on a rear side of the first duct 60.

The refrigerator 1 may include a second duct 69 provided to guide cold air to the second storage compartment 22 and the third storage compartment 23. The second duct 69 may guide the cold air generated by the second evaporator 13 to the second storage compartment 22 and the third storage compartment 23. The second duct 69 may be disposed in a rear portion of the second storage compartment 22 and the third storage compartment 23. The second duct 69 may accommodate the second blowing fan 15, the second damper 17, and the third damper 18. In the drawings, the second duct 69 is shown as having a different configuration from the first duct 60, but the present disclosure is not limited thereto. For example, in some cases, the first duct 60 and the second duct 69 may be provided as an integrated configuration.

However, the present disclosure is not limited to the above. It should be understood that, depending on the type of refrigerator 1, the arrangement, shape, number, or the like of the components for generating, supplying, and/or guiding cold air may vary. For example, contrary to what is shown in the drawings, the refrigerator 1 may include one evaporator. In such a case, at least one flow path may be provided to connect the space in which the evaporator is located with at least one storage compartment. For example, in contrast to what is shown in the drawings, the refrigerator 1 may include one duct. In such a case, the duct may be provided to communicate with all the storage compartments. The number of blowing fans and/or dampers may also vary.

Figure 3:
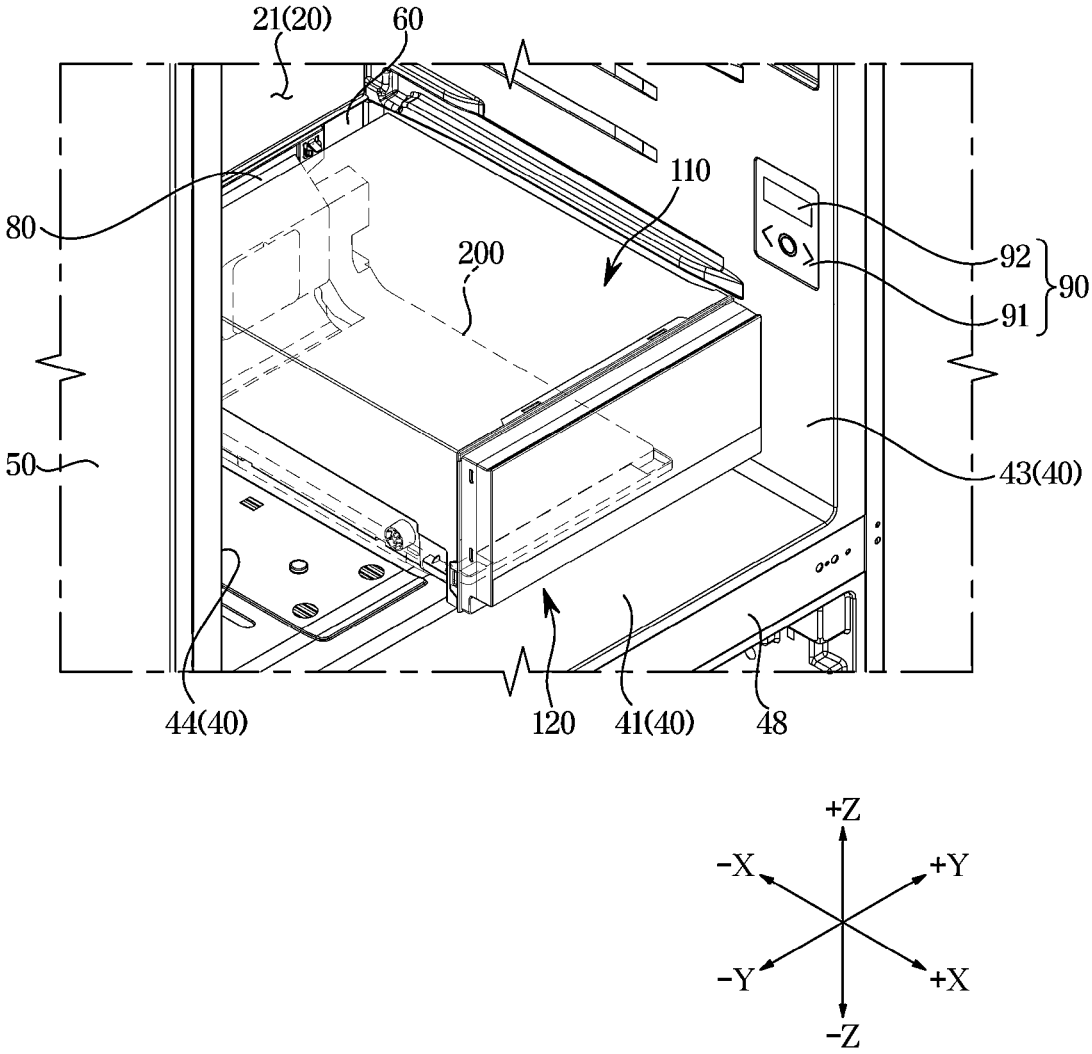
FIG. 3 is a view of a portion of the refrigerator according to an embodiment.
Figure 4:
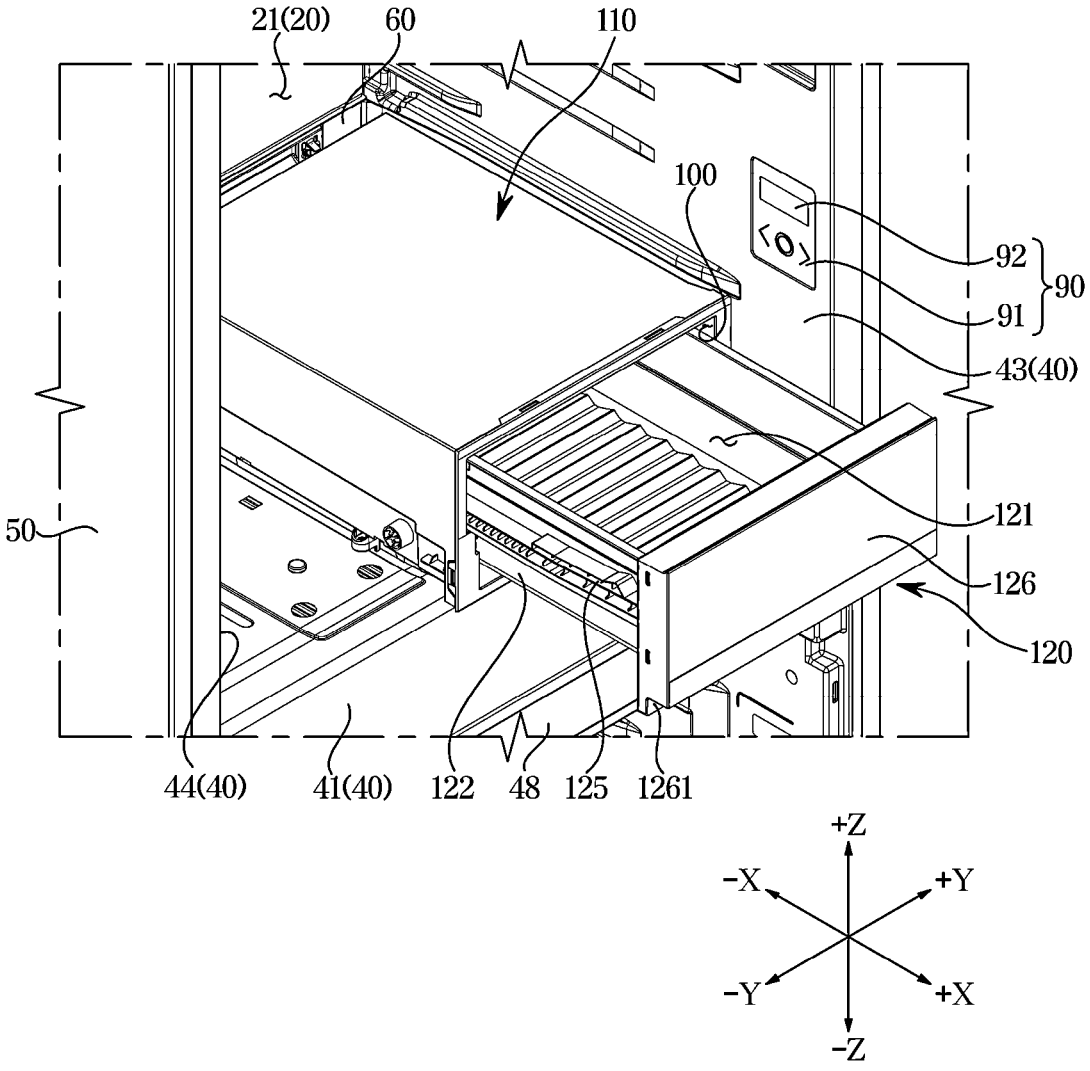
FIG. 4 is a view illustrating an example of the refrigerator shown in FIG. 3 with a drawer withdrawn from a drawer case.

FIG. 3 illustrates a portion of the refrigerator according to an embodiment. FIG. 4 illustrates an example of the refrigerator shown in FIG. 3 with a drawer withdrawn from a drawer case.

The refrigerator 1 may include the temperature control compartment 100 (see FIG. 4). The temperature control compartment 100 may be provided in the storage compartment 20. For example, the temperature control compartment 100 may be provided in at least one of the first storage compartment 21, the second storage compartment 22, or the third storage compartment 23. In the drawings, the refrigerator 1 is shown as including one temperature control compartment 100, but the present disclosure is not limited thereto. The refrigerator 1 may include a plurality of temperature control compartments 100, and each of the plurality of temperature control compartments 100 may be provided in the first storage compartment 21, the second storage compartment 22, or the third storage compartment 23.

However, an example in which the temperature control compartment 100 is provided in the first storage compartment 21 will be described below. For ease of description, the first storage compartment 21 may be referred to as the storage compartment 21, and the first duct 60 may be referred to as the duct 60. The temperature control compartment 100 and the configurations for controlling the temperature of the temperature control compartment 100 (e.g., a fan assembly 80, a heating assembly 200, and the like) described herein may be applicable to different cases, such as an example of the temperature control compartment being provided in the second compartment 22, an example of the temperature control compartment being provided in the third storage compartment 23, and an example of the temperature control compartment being provided in a single storage compartment. In addition, each of walls 41, 42, 43, 44, and 45 of the inner case 40 described herein may correspond to a wall for defining the storage compartment 21. For example, the inner case 40 may include the lower wall 41, the rear wall 42, the right wall 43, the left wall 44, and an upper wall 45 in order to define the storage compartment 21.

The temperature control compartment 100 may be disposed on an inside of the storage compartment 21. The temperature control compartment 100 may be arranged to have a temperature independent of the storage compartment 21. An internal temperature of the temperature control compartment 100 may be higher or lower than the internal temperature of the storage compartment 21. The internal temperature of the temperature control compartment 100 may have a different temperature from the internal temperature of the storage compartment 21 as set by the user. In some cases, the internal temperature of the temperature control compartment 100 may be the same as the internal temperature of the storage compartment 21.

For example, the temperature control compartment 100 may have a temperature at which food may be aged (or thawed). For example, food items that require aging (or thawing), such as kimchi, bread dough, meat, wine, and the like, may be stored in the temperature control compartment 100. For example, after the aging (or thawing) of food items stored in the temperature control compartment 100 is completed, the temperature control compartment 100 may be arranged to have the same temperature as the storage compartment 21. However, the present disclosure is not limited to the examples described above, and it should be understood that the temperature control compartment 100 may have different temperature ranges depending on the preferences of the user.

The refrigerator 1 may include a drawer case 110. The drawer case 110 may be positioned on the inside of the storage compartment 21. The drawer case 110 may be disposed on a front side of the fan assembly 80, which will be described later. The drawer case 110 may be disposed on a portion of the heating assembly 200, which will be described later. The drawer case 110 may be positioned in front of other portions of the heating assembly 200, which will be described later. A further detailed description of the heating assembly 200 and the fan assembly 80 will be described later.

The drawer case 110 may be arranged to form the temperature control compartment 100. The drawer case 110 may be arranged to accommodate a drawer 120, which will be described later. The drawer case 110 may have a shape that is a substantially open at the front.

The refrigerator 1 may include the drawer 120. The drawer 120 may be detachably mounted to the drawer case 110. The drawer 120 may be provided to be inserted into the drawer case 110 or to be removed from the drawer case 110. The drawer 120 may be arranged to be inserted into the drawer case 110 or removed from the drawer case 110 via the open front of the drawer case 110. The drawer 120 may have a shape that is substantially open at an upper surface.

The drawer 120 may include a storage space 121 to accommodate foods. The storage space 121 may accommodate a variety of foods, such as kimchi, bread dough, meat, wine, vegetables, and the like. However, the present disclosure is not limited thereto, and the storage space 121 may store a variety of items in addition to foods.

In response to the drawer 120 being inserted into the drawer case 110, the storage space 121 of the drawer 120 may be accommodated in the temperature control compartment 100. In other words, based on the storage space 121 of the drawer 120 being located within the temperature control compartment 100, food stored in the storage space 121 may also be located within the temperature control compartment 100. The food contained in the storage space 121 may be stored within the temperature control compartment 100 for a defined period of time. The food contained in the storage space 121 may be aged (or thawed) within the temperature control compartment 100.

A detailed description of each configuration of the drawer case 110 and the drawer 120 will be described later.

Figure 5:
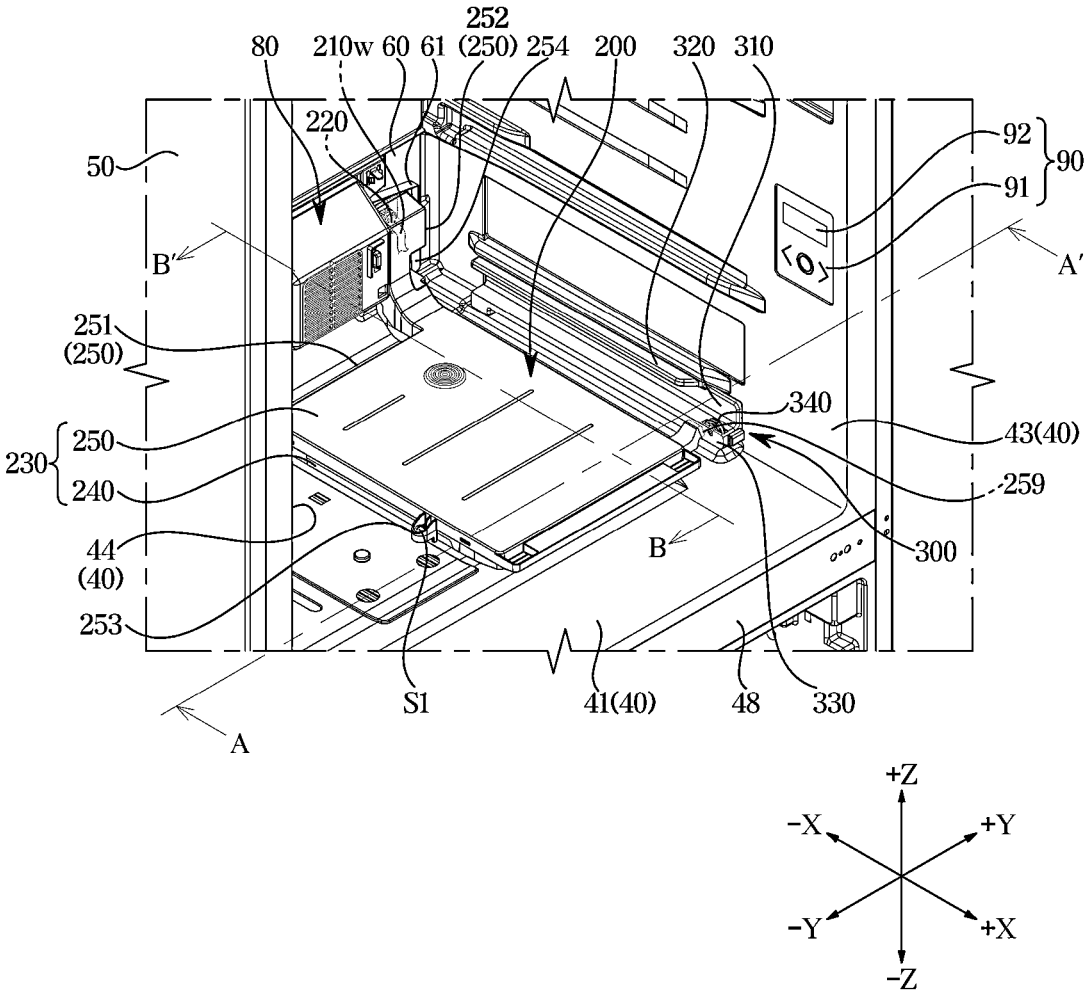
FIG. 5 is a view illustrating an example of the refrigerator shown in FIG. 3 with the drawer case and the drawer removed from the refrigerator.
Figure 6:
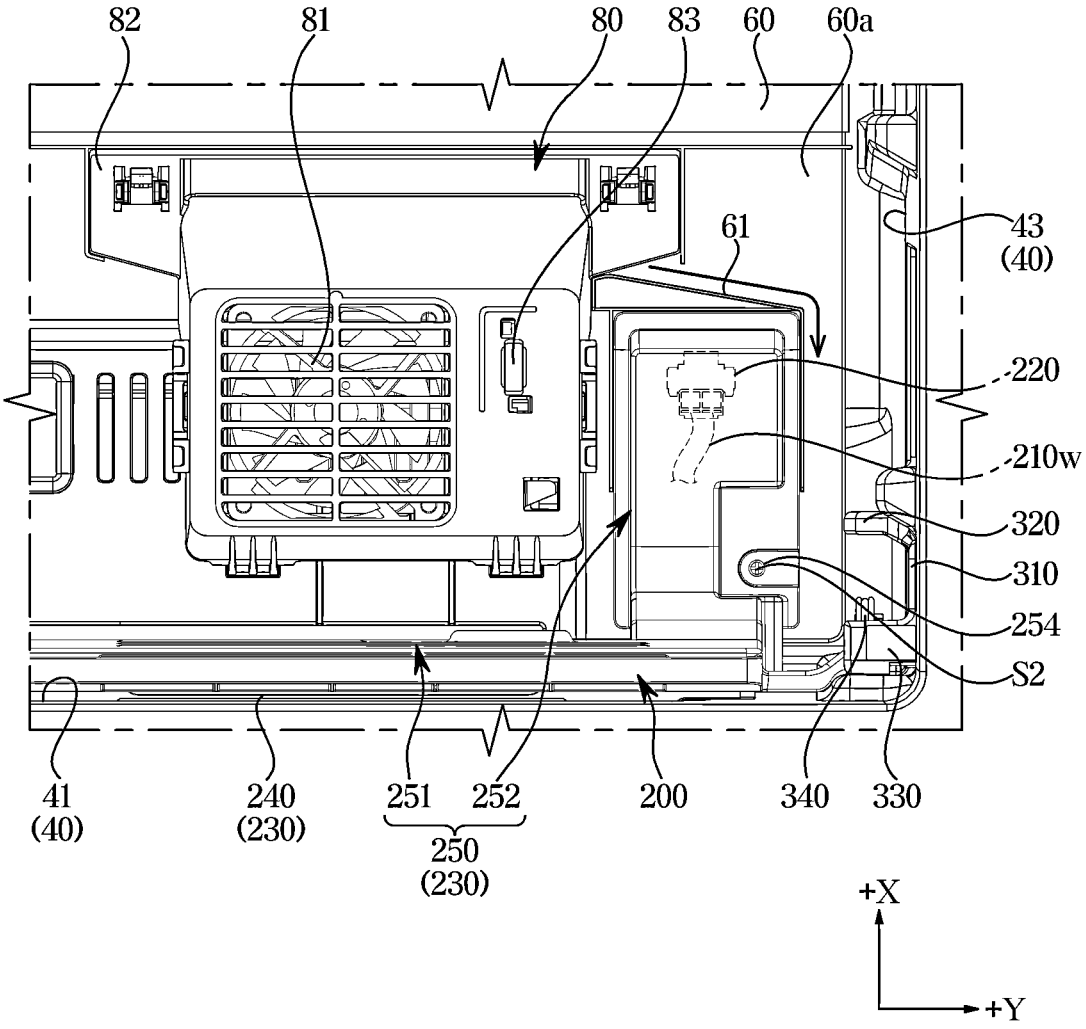
FIG. 6 is a front view of FIG. 5.
Figure 7:
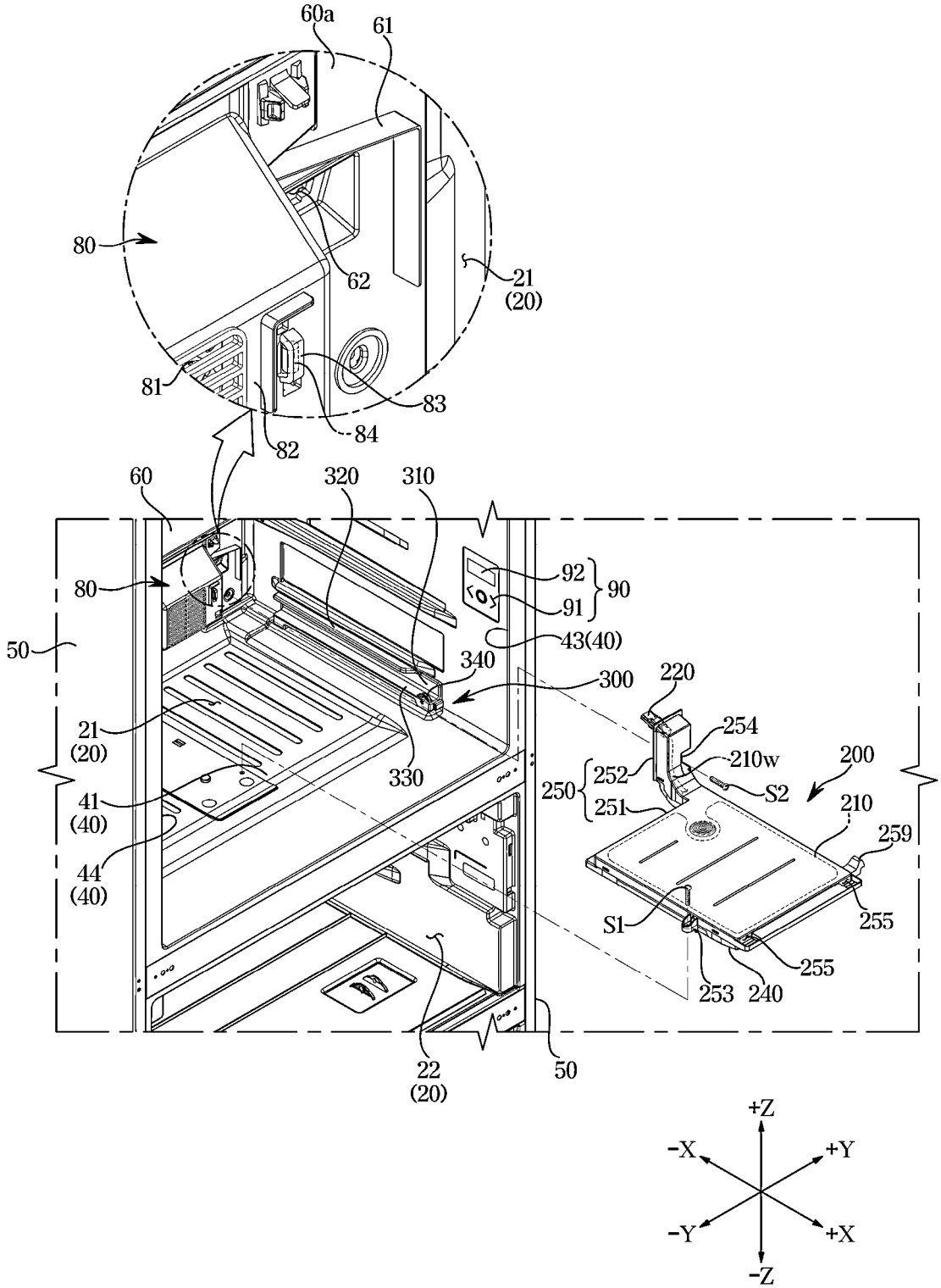
FIG. 7 is a view illustrating an example of the refrigerator shown in FIG. 5 with a heating assembly separated from a storage compartment.
Figure 8:
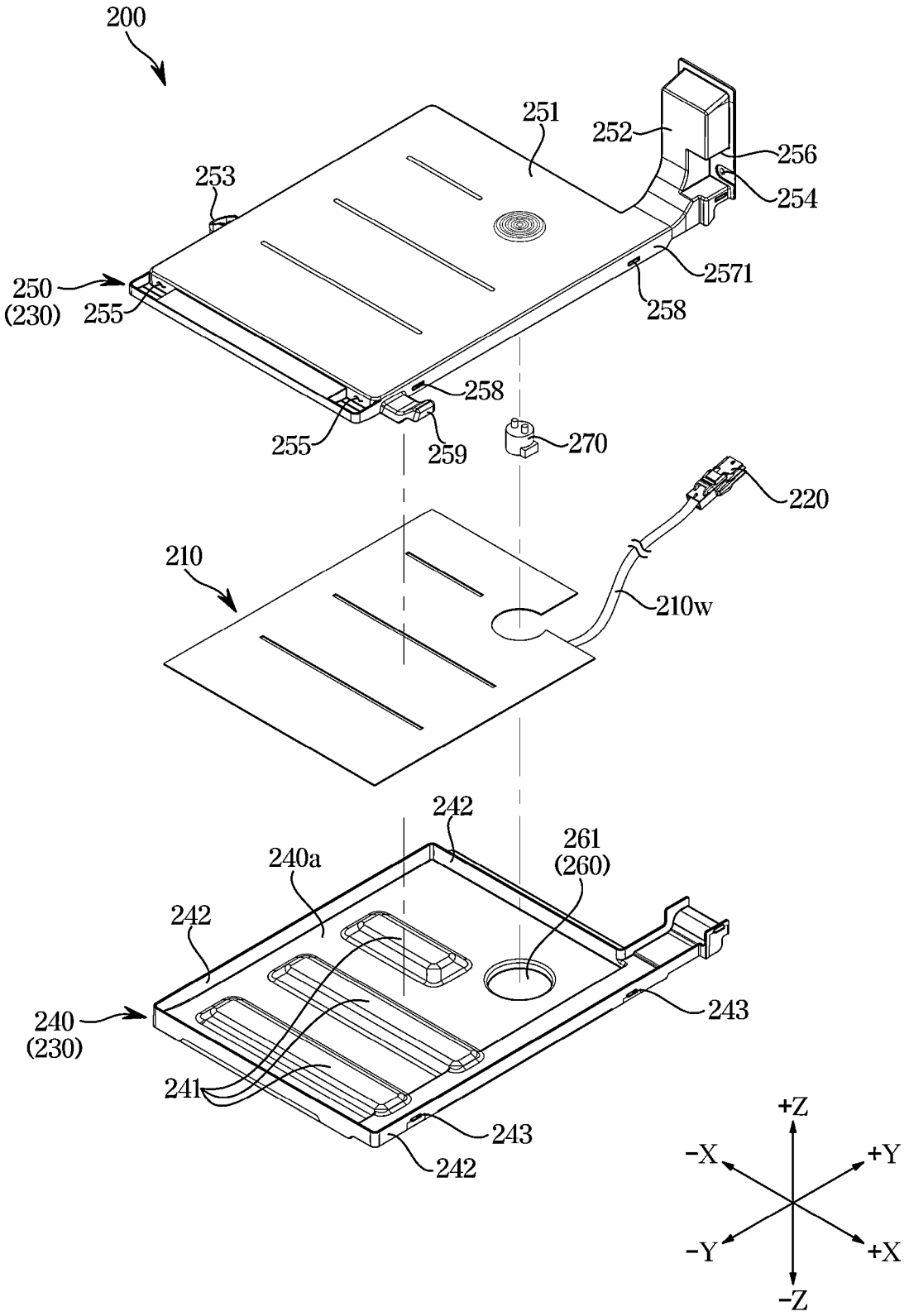
FIG. 8 is an exploded view illustrating the heating assembly according to an embodiment.
Figure 9:
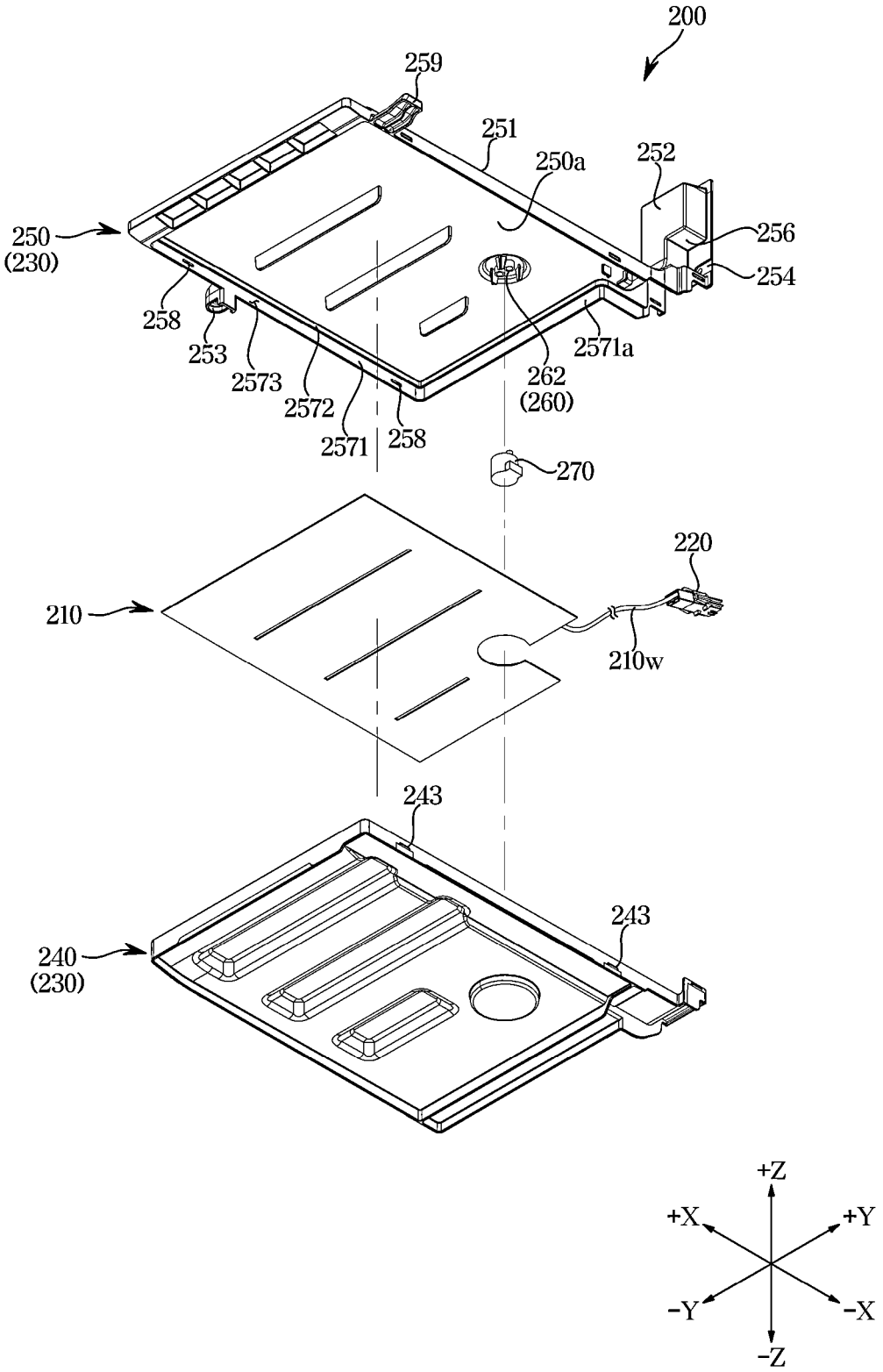
FIG. 9 is a view illustrating the heating assembly shown in FIG. 8 from a different orientation.

FIG. 5 illustrates an example of the refrigerator shown in FIG. 3 in which the drawer case and the drawer are removed. FIG. 6 illustrates a front view of FIG. 5. FIG. 7 illustrates an example of the refrigerator shown in FIG. 5 in which the heating assembly is separated from the storage compartment. FIG. 8 is an exploded view of the heating assembly according to an embodiment. FIG. 9 illustrates the heating assembly shown in FIG. 8 from a different orientation.

The refrigerator 1 may include a side frame 300. The side frame 300 may be provided in the storage compartment 21. The side frame 300 may be detachably mounted to the inner case 40. The side frame 300 may be detachably mounted to at least one of the two side walls 43 and 44 of the inner case 40. The side frame 300 may secure the drawer case 110, the storage container, the shelf, and the like to at least one of the two side walls 43 and 44 of the inner case 40.

An example in which the side frame 300 is mounted on the right wall 43 of the inner case 40 will be described. The side frame 300 may include a fixing panel 310 that is fixable to the right wall 43 of the inner case 40. The side frame 300 may include a first extension 320 protruding from the fixing panel 310 toward the inside of the inner case 40. The side frame 300 may include a second extension 330 spaced downwardly from the first extension 320 and protruding from the fixing panel 310 toward the inside of the inner case 40. A rail of sorts may be formed between the first extension 320 and the second extension 330. The drawer case 110, storage container, shelf, and the like may be detachably mounted on the rail formed between the first extension 320 and the second extension 330. The side frame 300 may include a rail roller 340 provided on the second extension 330. The rail roller 340 may be configured to guide the drawer case 110, storage container, shelf, and the like mounted on the rail formed between the first extension 320 and the second extension 330. However, the side frame 300 is not limited to the examples described above, and may be provided in a variety of shapes and/or arrangements to secure the drawer case 110, storage container, shelf, and the like to at least one of the two side walls 43 and 44 of the inner case 40.

The refrigerator 1 may include the fan assembly 80. The fan assembly 80 may be provided in the storage compartment 21. The fan assembly 80 may be configured to reduce the temperature of the temperature control compartment 100. The fan assembly 80 may be configured to cool the temperature control compartment 100. The fan assembly 80 may be arranged to face a rear surface 110*b* (see FIG. 14) of the drawer case 110.

The fan assembly 80 may be disposed on an outside of the temperature control compartment 100. In other words, the fan assembly 80 may be disposed on an outside of the drawer case 110. Since the fan assembly 80 is not disposed on an inside of the drawer case 110, space in the temperature control compartment 100 may be freed up. In other words, the space utilization of the temperature control compartment 100 may be improved. In addition, the drawer 120 may be freely attached to and detached from the drawer case 110 without interfering with the fan assembly 80.

The fan assembly 80 may include a fan 81 provided to move air in the storage compartment 21 into the temperature control compartment 100. The fan assembly 80 may include a fan case 82 provided to accommodate the fan 81. The fan case 82 may be detachably mounted to a front side 60*a* of the duct 60. The fan assembly 80 may include a temperature sensor 84 configured to detect a temperature in the temperature control compartment 100. For example, the temperature sensor 84 may be detachably mounted to a temperature sensor mount 83 formed in the fan case 82.

The refrigerator 1 may include the heating assembly 200. The heating assembly 200 may be provided in the storage compartment 21. The heating assembly 200 may be configured to increase the temperature of the temperature control compartment 100. The heating assembly 200 may be configured to heat the temperature control compartment 100. The heating assembly 200 may be configured to heat a lower portion of the temperature control compartment 100. The heating assembly 200 may be arranged to face a lower surface 110*a* of the drawer case 110 (see FIGS. 13 and 14). The heating assembly 200 may be arranged to face the rear surface 110*b* (see FIG. 14) of the drawer case 110.

The heating assembly 200 may be disposed on the outside of the temperature control compartment 100. In other words, the heating assembly 200 may be disposed on the outside of the drawer case 110. Since the heating assembly 200 is not disposed on the inside of the drawer case 110, space may be freed in the temperature control compartment 100. In other words, the space utilization of the temperature control compartment 100 may be improved. In addition, the drawer 120 may be freely attached to and detached from the drawer case 110 without interfering with the heating assembly 200.

The heating assembly 200 may include a heater 210. The heater 210 may generate heat. The heater 210 may heat the air inside the temperature control compartment 100. For example, the heater 210 may have a substantially plate shape. For example, the heater 210 may include two aluminum sheets and a heating wire disposed therebetween. However, the present disclosure is not limited to the examples described above, and the heater 210 may be provided in a variety of shapes and/or configurations.

The heating assembly 200 may include a connector 220. The connector 220 may be configured to supply power to the heater 210. The connector 220 may electrically connect the heater 210 to a controller 70 (see FIG. 19), which will be described later. For example, the connector 220 may be provided at one end of a wire 210*w* of the heater 210.

The connector 220 may be arranged to face a rear side of the storage compartment 21. The connector 220 may be arranged to face the rear wall 42 of the inner case 40. The connector 220 may be arranged to face the duct 60. The connector 220 may be configured to be holdable in the duct 60. The connector 220 may be configured to be mountable to the front side 60*a* of the duct 60. The connector 220 may be configured to be insertable into a connector hole 62 (see FIG. 7) of the duct 60. The connector 220 may be inserted into the connector hole 62 of the duct 60 and electrically connected to the controller 70.

The heating assembly 200 may include a heater case 230. The heater case 230 may be provided to accommodate the heater 210. The heater case 230 may be provided to accommodate a bimetal 270, which will be described later. The heater case 230 may be configured to cover the connector 220 mounted on the duct 60 (see FIGS. 5 and 6). As a result, the heater case 230 may prevent and/or reduce moisture from entering the connector 220 mounted on the duct 60.

The heater case 230 may include a lower frame 240. The heater case 230 may include an upper frame 250.

The lower frame 240 may be provided to be seated on the lower wall 41 of the inner case 40. The lower frame 240 may be placed on the lower wall 41 of the inner case 40. The lower frame 240 may have a shape with a substantially open upper surface.

The upper frame 250 may be configured to be releasably couplable to the lower frame 240. The upper frame 250 may be configured to cover an upper portion of the lower frame 240.

The upper frame 250 may include a body portion 251. The body portion 251 may be disposed on a lower side of the temperature control compartment 100. The body portion 251 may be configured to support the lower portion of the temperature control compartment 100. The body portion 251 may be arranged to face the lower surface 110*a* of the drawer case 110. The body portion 251 may be configured to support the lower surface 110*a* of the drawer case 110. The body portion 251 may be configured to be couplable to the lower surface 110*a* of the drawer case 110. The body portion 251 may be configured to be couplable to the lower wall 41 of the inner case 40. For example, the body portion 251 may have a shape with a substantially open lower surface.

The upper frame 250 may include a cover portion 252. The cover portion 252 may be configured to cover the connector 220 mounted on the duct 60. The cover portion 252 may extend upwardly from a rear side of the body portion 251. The cover portion 252 may be provided behind the temperature control compartment 100. The cover portion 252 may be arranged to face the rear surface 110*b* of the drawer case 110. The cover portion 252 may be arranged to be couplable to the front side 60*a* of the duct 60. For example, the cover portion 252 may have a shape with a substantially open rear side.

The heating assembly 200 may be arranged to be removable from the storage compartment 21 (see FIG. 7). The heater case 230 may be provided to be detachably couplable to the lower wall 41 of the inner case 40 and the front side of the duct 60. The heater case 230 may include a first coupling portion 253 couplable to the lower wall 41 of the inner case 40 and a second coupling portion 254 couplable to the front 60*a* of the duct 60.

For example, the first coupling portion 253 may be formed on the body portion 251 of the upper frame 250, and a first fastening member S1 may fasten the first coupling portion 253 to the lower wall 41 of the inner case 40. For example, the second coupling portion 254 may be formed on the cover portion 252 of the upper frame 250, and a second fastening member S1 may fasten the second coupling portion 254 to the front side 60*a* of the duct 60. For example, the body portion 251 of the upper frame 250 may include a fixing rib 259. The fixing rib 259 may be inserted between the lower wall 41 of the inner case 40 and the second extension 330 of the side frame 300.

The heating assembly 200 may include the bimetal 270. The bimetal 270 may be configured to prevent and/or reduce overheating of the heater 210. The bimetal 270 may be accommodated in the heater case 230. The heater case 230 may include a bimetal mounting portion 260 on which the bimetal 270 is mounted. For example, the bimetal mounting portion 260 may include a first mounting portion 261 formed on the lower frame 240 and on which the bimetal 270 is seated, and a second mounting portion 262 formed on the upper frame 250 to secure an upper portion of the bimetal 270.

Figure 10:
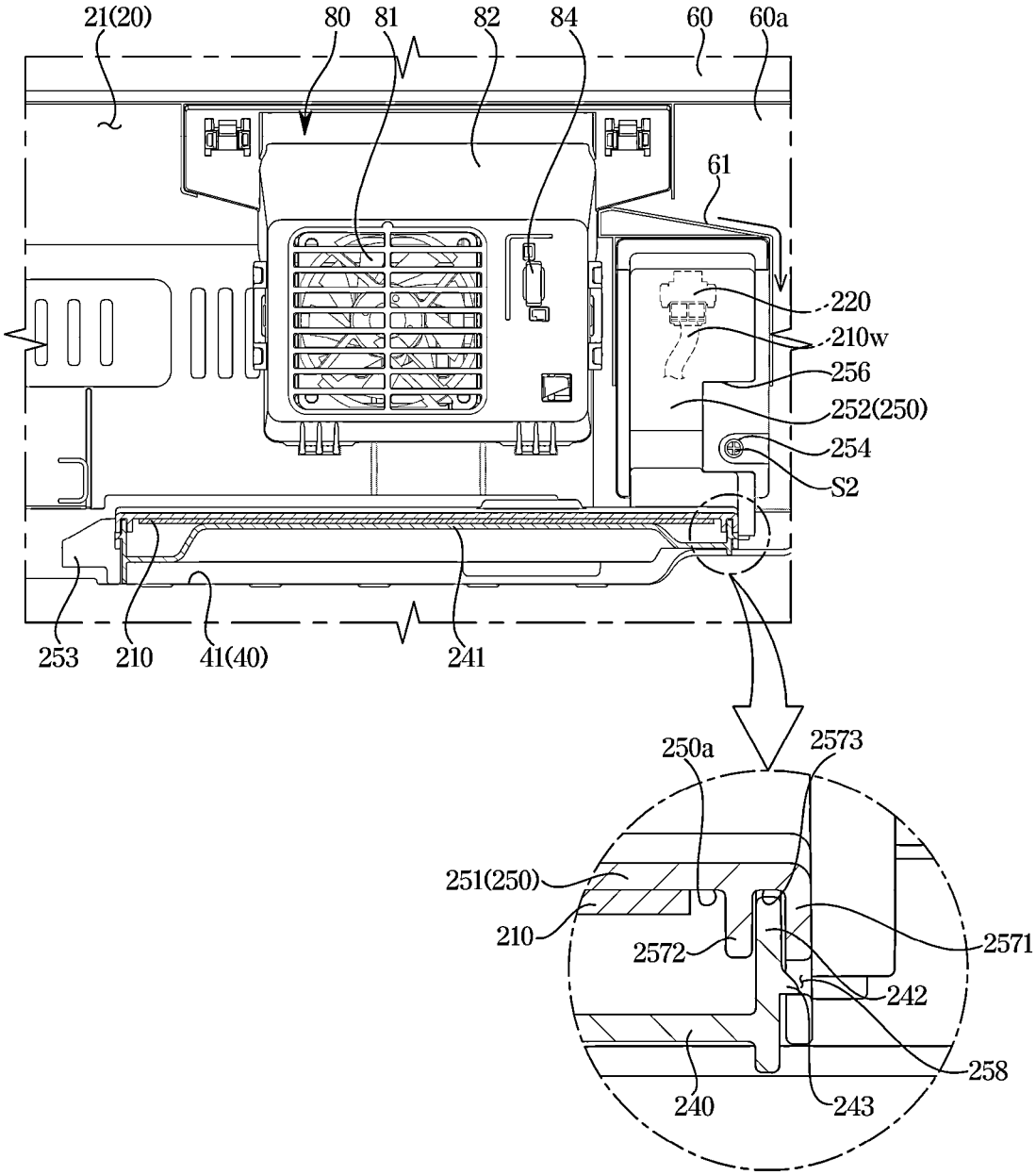
FIG. 10 is a cross-sectional view taken along the line A-A' shown in FIG. 5.
Figure 11:
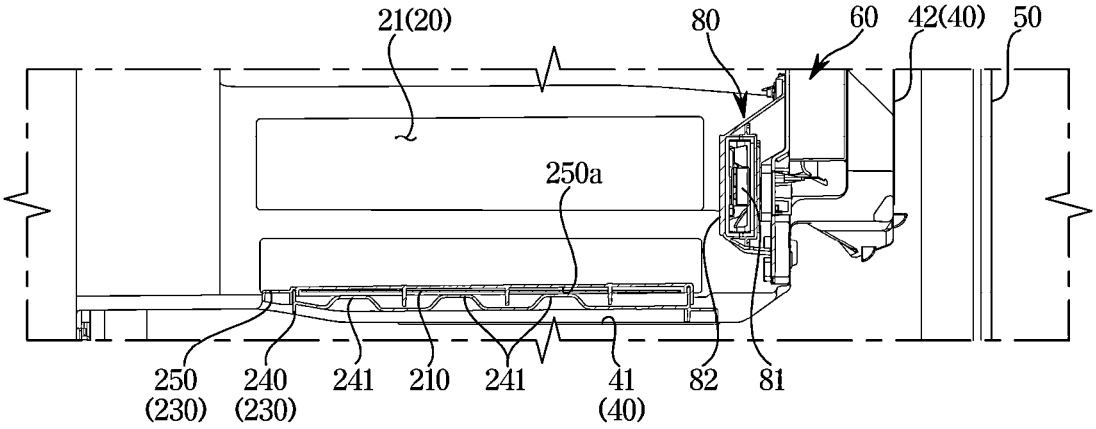
FIG. 11 is a cross-sectional view taken along the line B-B' shown in FIG. 5.

FIG. 10 is a cross-sectional view taken along line A-A' shown in FIG. 5. FIG. 11 is a cross-sectional view taken along line B-B' shown in FIG. 5.

The heater 210 may be mounted on an inner surface of the heater case 230. The heater 210 may be mounted on an inner surface of the upper frame 250. The heater 210 may be attached to an upper inner surface 250*a* of the upper frame 250. The heater 210 may be attached to an upper inner surface of the body portion 251.

The lower frame 240 may include a protrusion 241. The protrusion 241 may support the heater 210 to prevent and/or reduce the heater 210 from being separated from the upper frame 250. The protrusion 241 may be arranged to be in contact with the heater 210 to prevent and/or reduce the heater 210 from being deviating from the upper frame 250. The protrusion 241 may be arranged to protrude upwardly. The protrusion 241 may extend from a bottom 240*a* of the lower frame 240 toward the upper inner surface 250*a* of the upper frame 250. Three protrusions 241 are shown in the drawings, but the present disclosure is not limited thereto. There is no limit to the number of protrusions 241 as long as the protrusion 241 may support the heater 210.

According to an example of related technologies, a refrigerator may include a heater cover disposed adjacent to the temperature control compartment and a heater attached to the heater cover to generate heat. However, the heat generated by the heater may cause the heater cover to be deformed and the adhesive force between the heater cover and the heater to be weakened. As a result, the heater may be separated from the heater cover, and the performance of the heater may be deteriorated. In other words, when the heater is operated with the heater cover separated therefrom, heating of the temperature control compartment may not be facilitated.

In contrast, according to the present disclosure, the protrusions 241 of the lower frame 240 may support the heater 210, and thus the heater 210 may not be easily separated from the upper frame 250. The protrusions 241 may bring the heater 210 and the upper frame 250 into close contact. That is, the heater 210 may be maintained mounted on the upper frame 250 by the protrusions 241. Accordingly, the performance of the heater 210 may not be degraded, and the heating assembly 200 may easily heat the temperature control compartment 100.

The duct 60 may include the connector hole 62 (see FIG. 7) into which the connector 220 may be inserted. The connector 220 may be mounted on the duct 60 by being inserted into the connector hole 62. Accordingly, the connector 220 may be arranged to face the rear wall 42 of the inner case 40. The connector 220 may not be disposed on the lower wall 41 of the inner case 40.

The duct 60 may include a guide rib 61. The guide rib 61 may protrude from the front side 60*a* of the duct 60. The guide rib 61 may be disposed above the connector 220 mounted on the duct 60. The guide rib 61 may be disposed on the cover portion 252 of the upper frame 250. However, the guide rib 61 may not be provided as a part of the duct 60, but may be provided in a configuration separate from the duct 60 and assembled at the front side 60*a* of the duct 60.

The guide rib 61 may be configured to guide moisture downwardly. For example, the guide rib 61 may have a shape inclined downwardly toward one side wall 43 or 44 of the inner case 43. For example, the guide rib 61 may have a shape inclined downwardly toward the right wall 43 of the inner case 43. Accordingly, moisture within the storage compartment 21 may be smoothly guided downwardly by the guide rib 61 (see arrow in FIG. 10). The moisture guided by the guide rib 61 may fall on the lower wall 41 of the inner case 40. The moisture guided by the guide rib 61 may be arranged to avoid the cover portion 252 and the connector 220 covered by the cover portion 252. The moisture guided by the guide rib 61 may not flow into the cover portion 252 and the connector 220 covered by the cover portion 252. The moisture flowing or condensing on the front side 60*a* of the duct 60 may not enter the cover portion 252 and the connector 220 covered by the cover portion 252.

According to an example of related technologies a refrigerator may include a heater, a connector that supplies power to the heater and is disposed on the lower wall of the inner case, and a heater cover to cover the heater and the connector. However, in such a case, the connector may be susceptible to moisture ingress. Moisture may collect on the lower wall of the inner case. For example, when a refrigerator is in a defrost operation, defrost water may collect on the lower wall of the inner case. For example, frost formed on the side walls of the inner case or in front of the duct or the like may melt and collect on the lower wall of the inner case. At this time, the moisture collected on the lower wall of the inner case may flow into the connector disposed on the lower wall of the inner case. In the event of moisture entering the connector, a fire may occur. To prevent such a situation, a separate gasket may be required between the heater cover and the lower wall of the inner case. In addition, separate protrusions and/or grooves may be formed on the lower wall of the inner case to secure the gasket to the inner case. When replacing the heater and heater cover with a general storage container or shelf or the like, the general storage container or shelf or the like may interfere with the projections and/or grooves formed on the lower wall of the inner case.

In contrast, according to the present disclosure, the connector 220 may be mounted on the duct 60 so as to face the rear wall 42 of the inner case 40, and the guide rib 61 of the duct 60 may guide moisture downwardly. Accordingly, it may be difficult for moisture in the storage compartment 21 to enter the connector 220. For example, the connector 220 may not be disposed on the lower wall 41 of the inner case 40, and thus the moisture collected on the lower wall 41 of the inner case 40 may not enter the connector 220. For example, the moisture flowing or condensing on the front side 60*a* of the duct 60 may be guided to the lower wall 41 of the inner case 40 by the guide rib 61, avoiding the connector 220. Consequently, according to the present disclosure, the heating assembly 200 may not require a separate gasket. In other words, the heating assembly 200 may easily prevent and/or reduce moisture from entering the connector 220 without a gasket. Since moisture is prevented and/or reduced from entering the connector 220, a fire may also be prevented and/or reduced. Furthermore, the safety of use of the refrigerator 1 may be improved. In addition, separate protrusions and/or grooves may not be formed on the lower wall 41 of the inner case 40. The heating assembly 200 may easily be replaced by a general storage container or shelf, so that the use of the storage compartment 21 may be increased.

Meanwhile, an example in which the upper frame 250 and the lower frame 240 are coupled will be described. The upper frame 250 may include a first sealing protrusion 2571 that protrudes downwardly from an edge of the upper frame 250. The upper frame 250 may include a second sealing protrusion 2572 that is spaced apart from the first sealing protrusion 2571 and protrudes downwardly therefrom. The upper frame 250 may include a sealing groove 2573 formed between the first sealing protrusion 2571 and the second sealing protrusion 2572. The sealing groove 2573 may have a relatively depressed shape relative to the first sealing protrusion 2571 and the second sealing protrusion 2572. The lower frame 240 may include a third sealing protrusion 242 that is receivable in the sealing groove 2573. The third sealing protrusion 242 may protrude upwardly from an edge of the lower frame 240. The third sealing protrusion 242 may be inserted into the sealing groove 2573. The first sealing protrusion 2571 and the second sealing protrusion 2572 may be disposed on an outside and an inside of the third sealing protrusion 242, respectively. As a result, the heater case 230 may have a structure that doubly prevents and/or reduce moisture ingress.

An example in which the upper frame 250 and the lower frame 240 are coupled will be described. The upper frame 250 may include a hook hole 258 formed in the first sealing protrusion 2571. The hook hole 258 may be provided to correspond to a hook 243 of the lower frame 240, which will be described later. The lower frame 240 may include a hook 243 protruding from the third sealing protrusion 242. The hook 243 may be inserted into the hook hole 258. For example, the hook 243 may protrude from the third sealing protrusion 242 toward the first sealing protrusion 2571.

By the examples described above, the upper frame 250 and the lower frame 240 may be tightly coupled. In addition, it is moisture may be more reliably prevented and/or reduced from entering the heating assembly 200.

Figure 12:
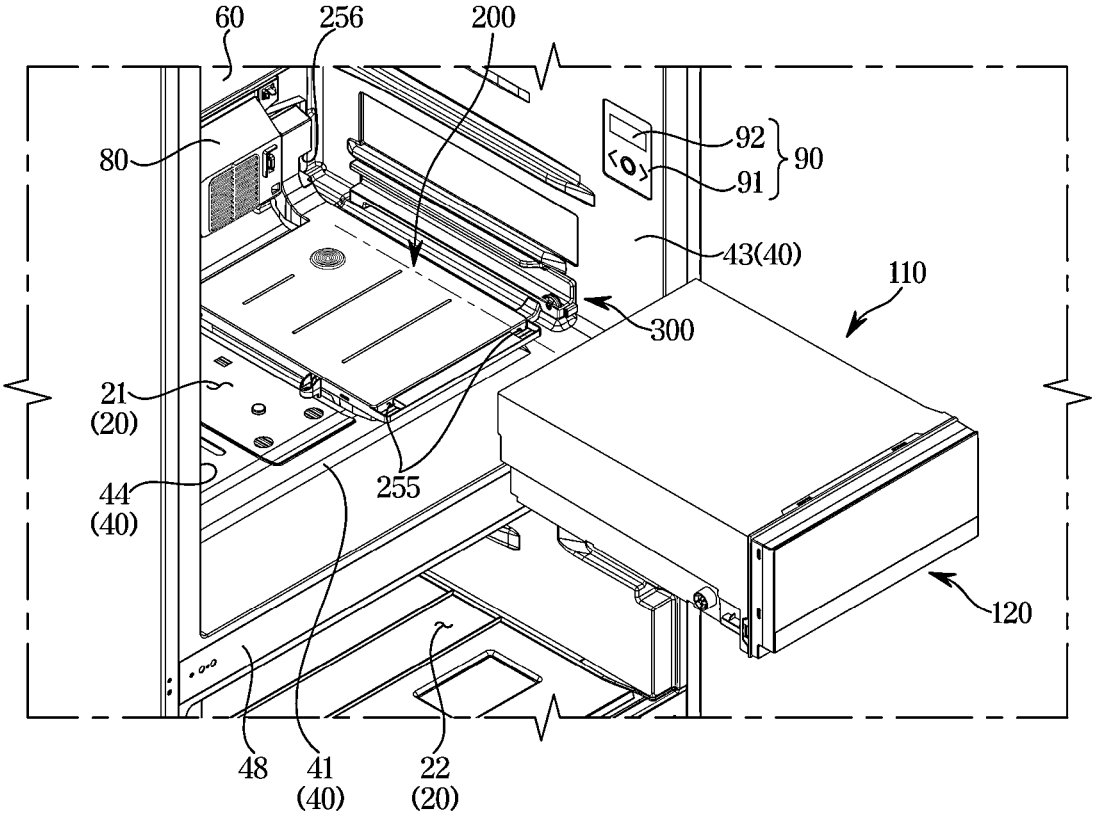
FIG. 12 is a view illustrating an example of the drawer case and the drawer separated from the storage compartment in the refrigerator according to an embodiment.
Figure 13:
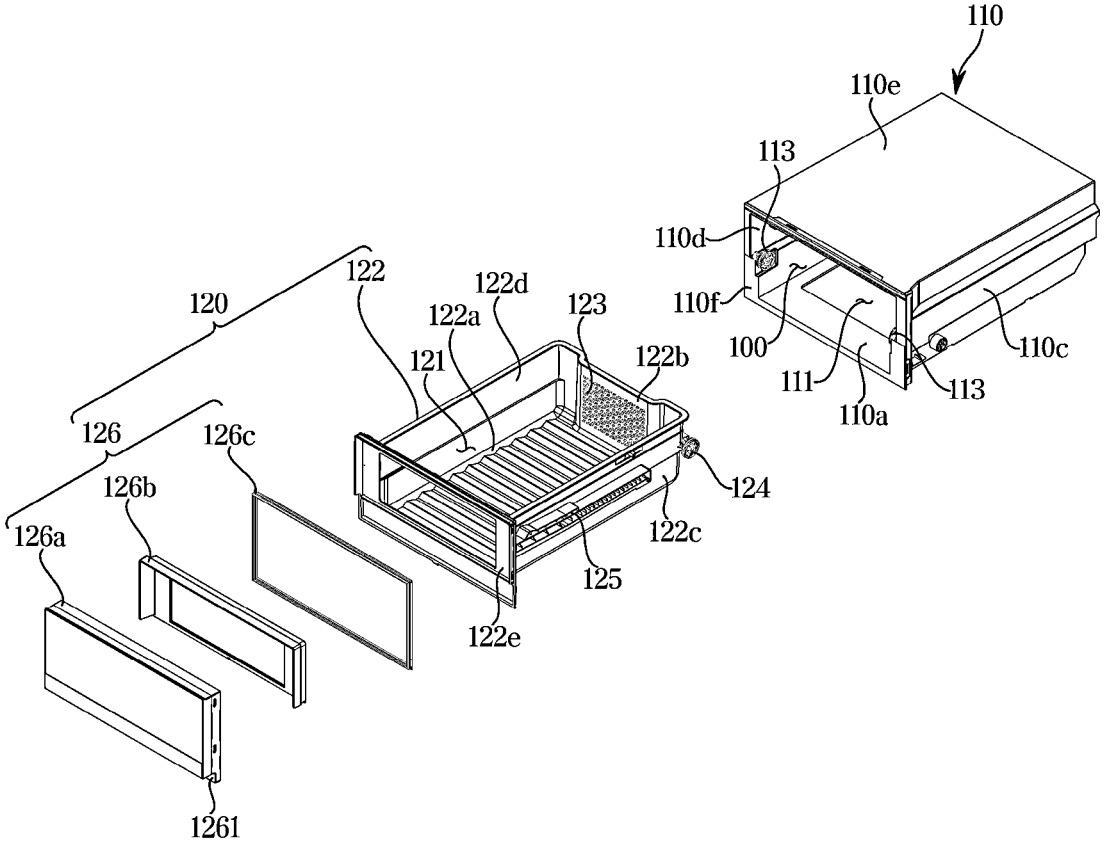
FIG. 13 is a view illustrating an example of the drawer case and the drawer.
Figure 14:
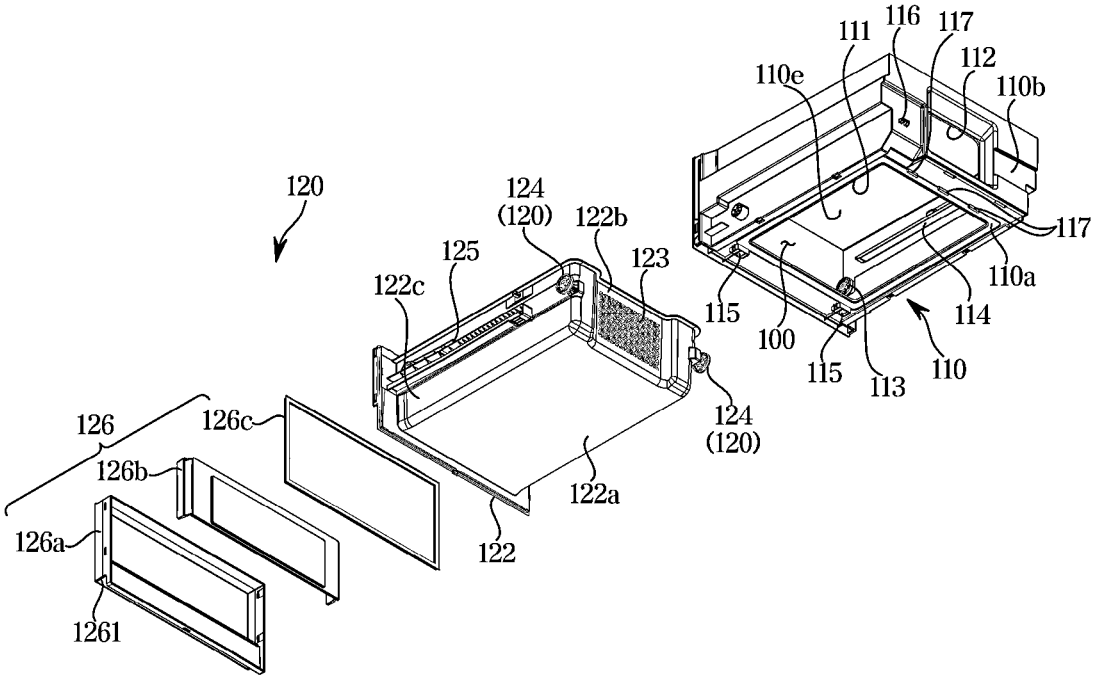
FIG. 14 is a view illustrating the drawer case and the drawer shown in FIG. 13 from a different orientation.

FIG. 12 illustrates an example of a state in which the drawer case and the drawer are separated from the storage compartment in the refrigerator according to an embodiment. FIG. 13 illustrates an example of the drawer case and the drawer. FIG. 14 illustrates the drawer case and the drawer shown in FIG. 13 from a different orientation.

Referring to FIG. 12, the drawer case 110 may be arranged to be removable from the storage compartment 21. The drawer case 110 may be arranged to be interchangeable with a general storage container, shelf, or the like. For example, when the temperature control compartment 100 is not in use, the user may disassemble the drawer case 110 from the storage compartment 21 and assemble a conventional storage container, shelf, or the like into the side frame 300. At this time, the user may disassemble the fan assembly 80 and/or the heating assembly 200 from the storage compartment 21 to secure more space in the storage compartment 21.

The drawer 120 may be arranged to be separable from the storage compartment 21. Based on the drawer case 110 being separated from the storage compartment 21, the drawer 120 inserted into the drawer case 110 may also be separated from the storage compartment 21. However, in contrast to what is shown in FIG. 12, the drawer 120 may not be needed to be separated from the storage compartment 21 while being inserted into the drawer case 110. The drawer 120 may be separated from the storage compartment 21 by being pulled out of the drawer case 110 disposed in the storage compartment 21.

Referring to FIGS. 13 and 14, the drawer case 110 may have a substantially box shape. For example, the drawer case 110 may include the lower surface 110*a*, the rear surface 110*b*, a right surface 110*c*, a left surface 110*d*, an upper surface 110*e*, and a front surface 110*f*. For example, at least a portion of the front surface 110*f* of the drawer case 110 may be open to allow the drawer 120 to be inserted into and withdrawn from the drawer case 110.

The drawer case 110 may include a first case hole 111. The first case hole 111 may be formed on the lower surface 110*a* of the drawer case 110. The first case hole 111 may be provided to correspond to the body portion 251 of the upper frame 250. The first case hole 111 may be arranged to face the body portion 251 of the upper frame 250. The lower surface of the drawer 120 (i.e., a lower surface 122*a* of the drawer body 122) inserted into the drawer case 110 may be arranged to face the body portion 251 of the upper frame 250 through the first case hole 111. By forming the first case hole 111 in the drawer case 110, the temperature control compartment 100 may be quickly heated by the heating assembly 200. By forming the first case hole 111 in the drawer case 110, the storage space 121 of the drawer 120 inserted into the drawer case 110 may be quickly heated by the heating assembly 200.

The drawer case 110 may include a second case hole 112. The second case hole 112 may be formed on the rear surface 110*b* of the drawer case 110. The second case hole 112 may be arranged to correspond to the fan assembly 80. The second case hole 112 may be arranged to face the fan 81. The rear surface of the drawer 120 (i.e., a rear surface 122*b* of the drawer body 122) inserted into the drawer case 110 may be arranged to face the fan 81 through the second case hole 112. By forming the second case hole 112 in the drawer case 110, the temperature control compartment 100 may be quickly cooled by the fan assembly 80. By forming the second case hole 112 in the drawer case 110, the storage space 121 of the drawer 120 inserted into the drawer case 110 may be quickly cooled by the fan assembly 80.

The drawer case 110 may include a pair of case rollers 113. The pair of case rollers 113 may be provided on an inner side of both side surfaces 110*c* and 110*d* of the drawer case 110. The pair of case rollers 113 of the drawer case 110 may correspond to a pair of rails 125 of the drawer 120, which will be described later.

The drawer case 110 may include a pair of case rails 114. The pair of case rails 114 may be provided on an inner side of both side surfaces 110*c* and 110*d* of the drawer case 110. The pair of case rails 114 may have an elongated shape along a moving direction of the drawer 120. The pair of case rails 114 of the drawer case 110 may correspond to a pair of drawer rollers 124 of the drawer 120, which will be described later.

The drawer case 110 may include a first locking protrusion 115. The first locking protrusion 115 may be formed on the lower surface 110*a* of the drawer case 110. The first locking protrusion 115 may protrude from the lower surface 110*a* of the drawer case 110. Two first locking protrusions 115 are shown in FIG. 14, but the present disclosure is not limited thereto. The first locking protrusion 115 may be provided as one or three or more, and there is no limit to the number of first locking protrusions 115.

The drawer case 110 may include a second locking protrusion 116. The second locking protrusion 116 may be formed on the rear surface 110*b* of the drawer case 110. The second locking protrusion 116 may protrude from the rear surface 110*b* of the drawer case 110. One second locking protrusion 116 is shown in FIG. 14, but the present disclosure is not limited thereto. The second locking protrusions 116 may be provided as two or more, and there is no limit to the number of second locking protrusions 116.

The drawer case 110 may include a third locking protrusion 117. The third locking protrusion 117 may be formed on the lower surface 110*a* of the drawer case 110. The third locking protrusion 117 may protrude from the lower surface 110*a* of the drawer case 110. The third locking protrusion 117 may be arranged to be spaced rearwardly from the first locking protrusion 115. Three third locking protrusions 117 are shown in FIG. 14, but the present disclosure is not limited thereto. The third locking protrusions 117 may be provided as two or fewer, and there is no limit to the number of third locking protrusions 117.

A more detailed description of the at least one locking protrusion 115, 116 and/or 117 of the drawer case 110 will be described later.

The drawer 120 may include the drawer body 122 forming the storage space 121. For example, the drawer body 122 may include the lower surface 122*a*, the rear surface 122*b*, a right surface 122*c*, a left surface 122*d*, and a front surface 122*e*. For example, the drawer body 122 may have a shape with an open top for loading and unloading food or the like.

The drawer 120 may include a drawer hole 123. The drawer hole 123 may be formed on the rear surface 122*b* of the drawer body 122. The drawer hole 123 may be provided to correspond to the second case hole 112 of the drawer case 110. Air blown by the fan 81 may easily enter the storage space 121 through the drawer hole 123. In other words, by forming the drawer hole 123 in the drawer body 122, the storage space 121 may be quickly cooled by the fan assembly 80.

The drawer 120 may include the pair of drawer rollers 124. The pair of drawer rollers 124 may be provided on an outer side of both side surfaces 122*c* and 122*d* of the drawer body 122. While the drawer 120 is being inserted into or withdrawn from the drawer case 110, the pair of drawer rollers 124 may be guided by the pair of case rails 114. The drawer 120 may be arranged to move slidably relative to the drawer case 110. Accordingly, the drawer 120 may be more smoothly inserted into and/or withdrawn from the drawer case 110.

The drawer 120 may include the pair of drawer rails 125. The pair of drawer rails 125 may be provided on the outer side of both side surfaces 122*c* and 122*d* of the drawer body 122. While the drawer 120 is inserted into or withdrawn from the drawer case 110, the pair of drawer rails 125 may be guided by the pair of case rollers 113. The drawer 120 may be arranged to move slidably relative to the drawer case 110. Accordingly, the drawer 120 may be more smoothly inserted into and/or withdrawn from the drawer case 110.

The drawer 120 may include a drawer panel 126 provided to cover a front side of the drawer body 122. The drawer panel 126 may be detachably coupled to the front side of the drawer body 122. The drawer panel 126 may include a handle 1261. The user may grasp the handle 1261 to insert the drawer 120 into the drawer case 110 or withdraw the drawer 120 from the drawer case 110.

For example, the drawer panel 126 may include a first panel 126*a*, a second panel 126*b*, and a gasket 126*c*. For example, at least one of the first panel 126*a* and the second panel 126*b* may be configured to block heat or cold air from leaking out of the drawer body 122. For example, the gasket 126*c* may be arranged to seal between the drawer panel 126 and the drawer case 110. However, the present disclosure is not limited to the examples described above, and the drawer panel 126 may be provided as a single configuration.

In the drawings, the drawer body 122 and the drawer panel 126 are shown as separate configurations, but the present disclosure is not limited thereto. For example, the drawer body 122 and the drawer panel 126 may be provided as an integrated configuration.

Figure 15:
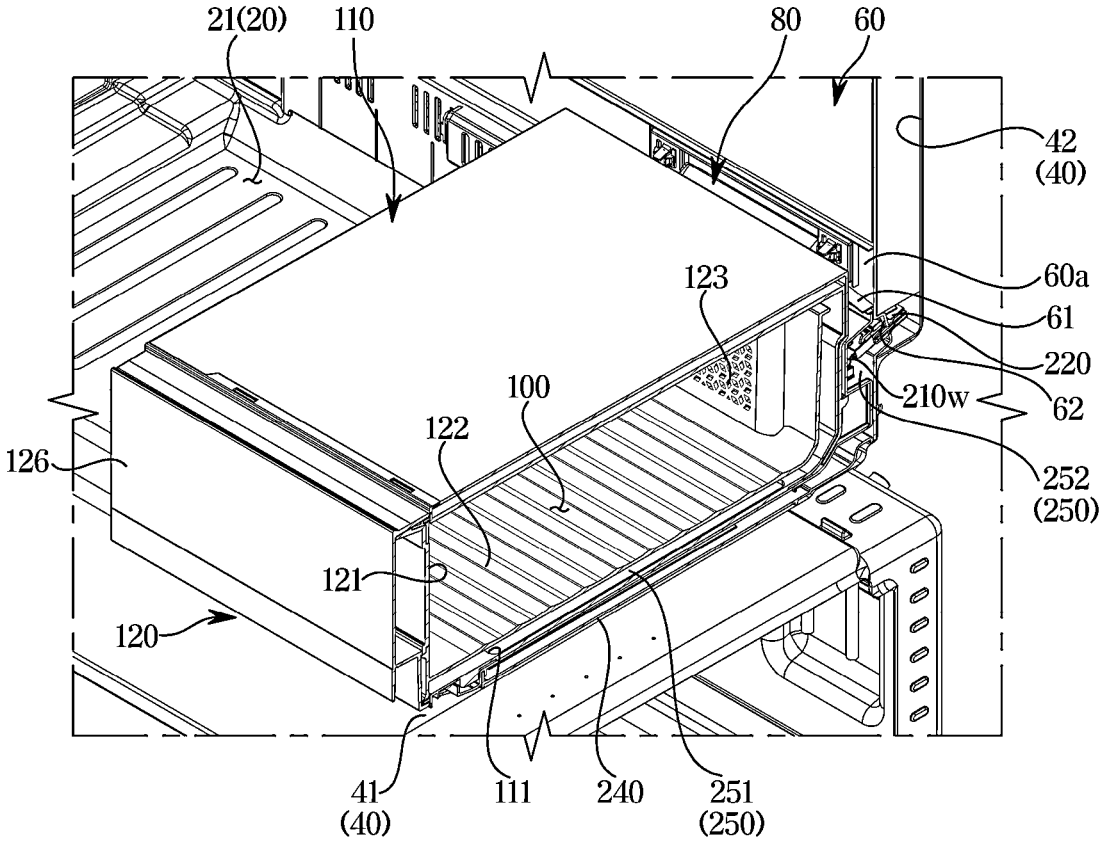
FIG. 15 is a cutaway view illustrating a section of the refrigerator according to an embodiment.
Figure 16:
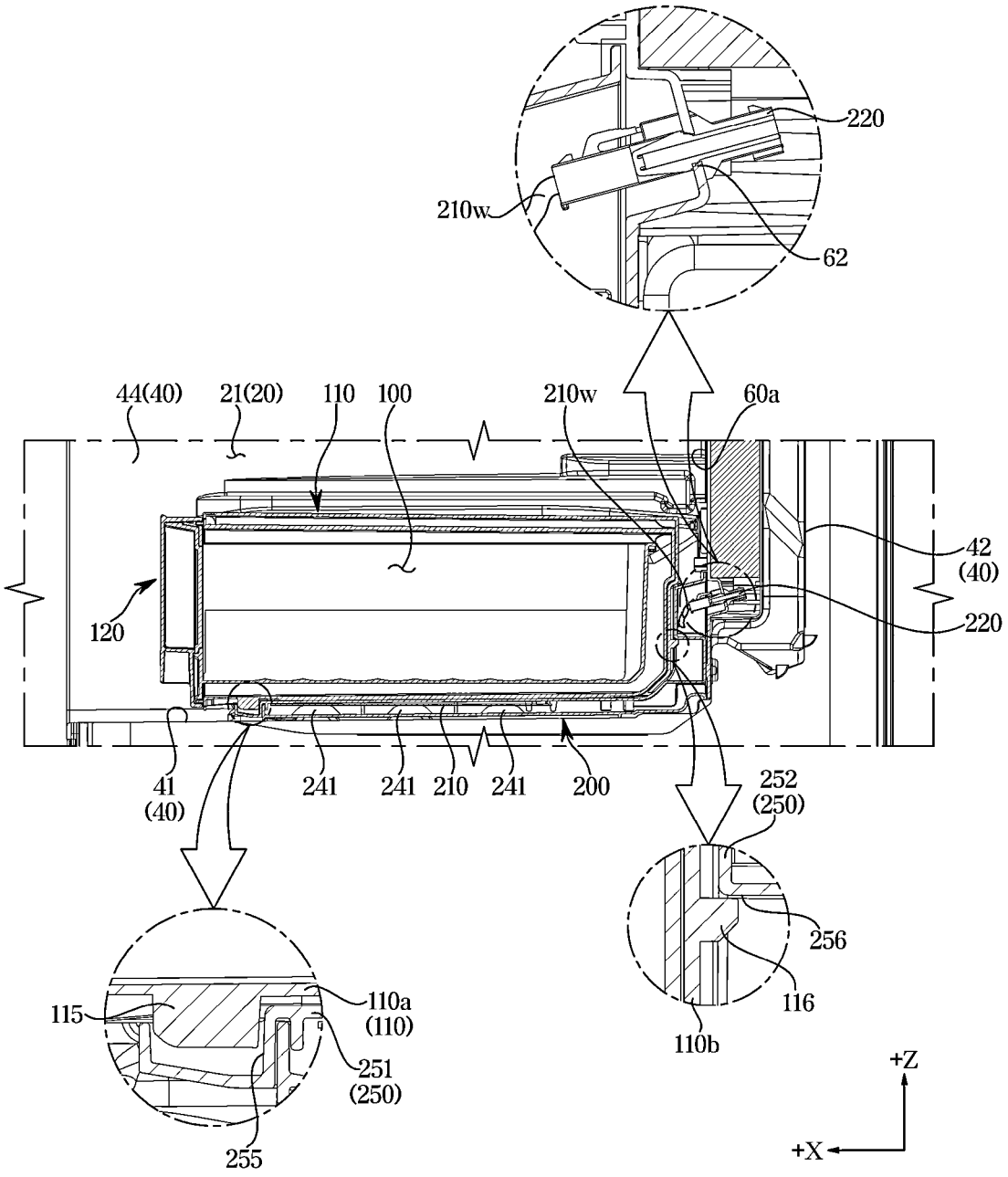
FIG. 16 is a cross-sectional view of FIG. 15.
Figure 17:
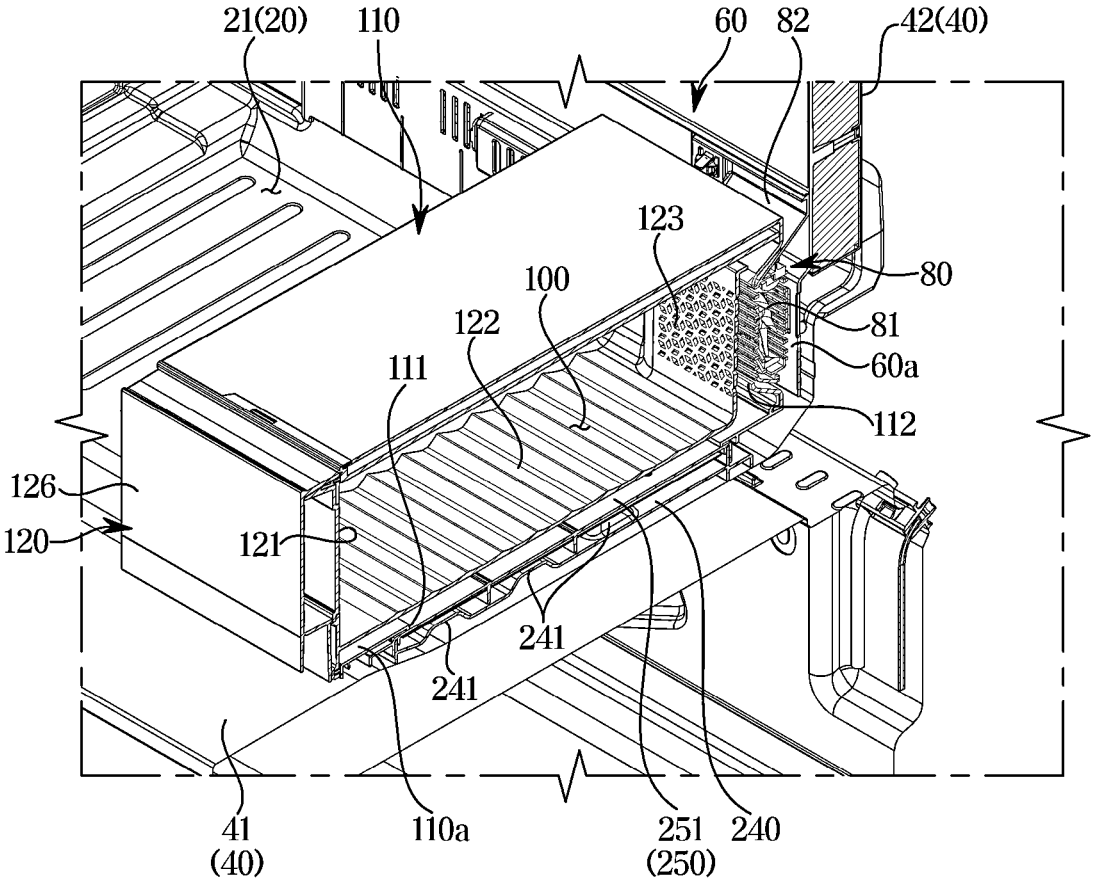
FIG. 17 is a cutaway view illustrating a section of the refrigerator according to an embodiment.
Figure 18:
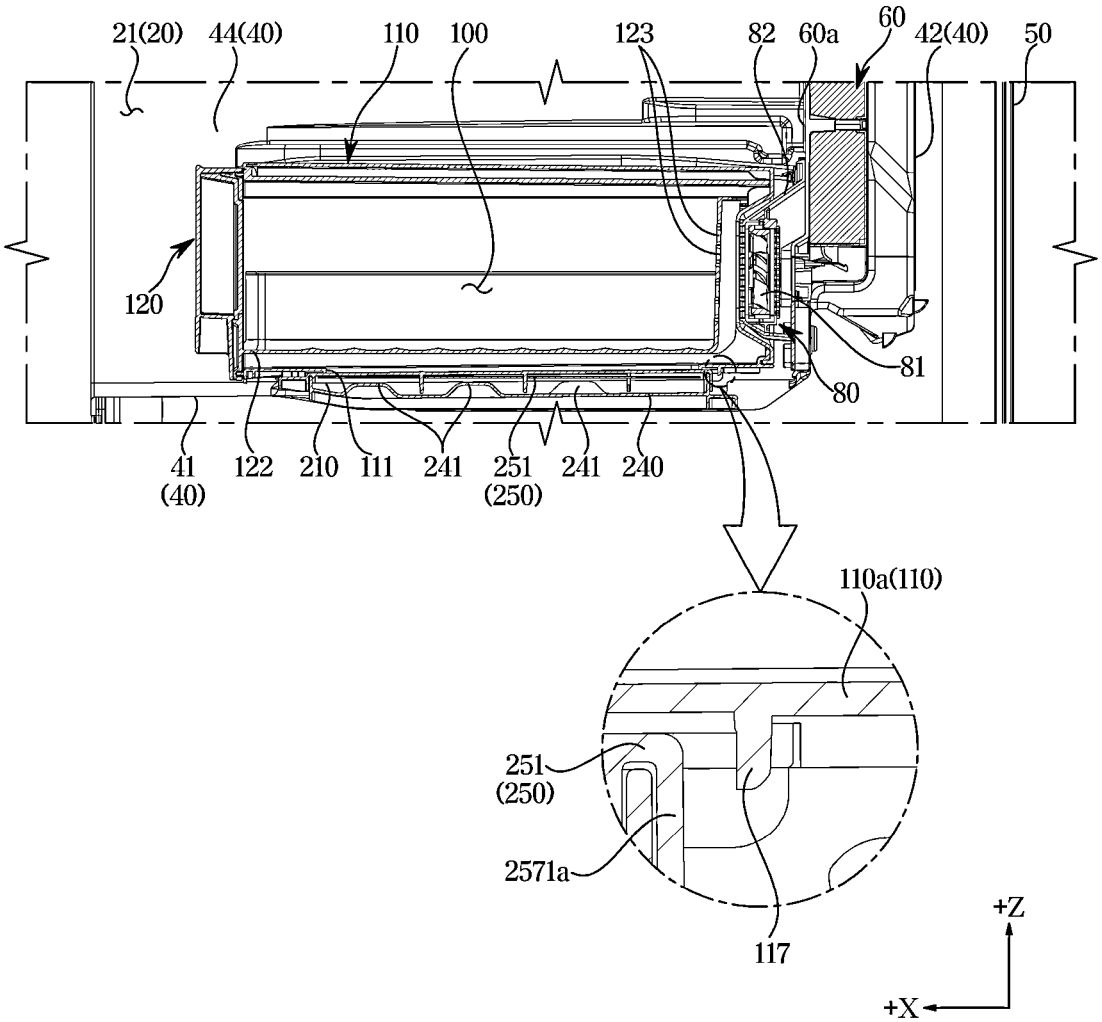
FIG. 18 is a cross-sectional view of FIG. 17.

FIG. 15 illustrates a partially cutaway section of the refrigerator according to an embodiment. FIG. 16 illustrates a cross-sectional view of FIG. 15. FIG. 17 illustrates a partially cutaway section of the refrigerator according to an embodiment. FIG. 18 illustrates a cross-sectional view of FIG. 17.

Referring to FIGS. 15 to 18, the drawer case 110 may be detachably coupled to the heating assembly 200. The drawer case 110 may be detachably couplable to the heater case 230. Because the drawer case 110 is coupled to the heater case 230 within the storage compartment 21, the temperature control compartment 100 may be implemented within the storage compartment 21. As the drawer case 110 is separated from the heater case 230 within the storage compartment 21, the temperature control compartment 100 may be removed from the storage compartment 21.

Next, examples in which the drawer case 110 and the heating assembly 200 are coupled will be described.

Referring to FIGS. 15 and 16, the drawer case 110 may include the first locking protrusions 115 protruding from the lower surface 110*a* of the drawer case 110. The upper frame 250 may include locking grooves 255 provided to correspond to the first locking protrusions 115. The locking grooves 255 may be formed in the body portion 251 of the upper frame 250. The locking protrusions 115 may be accommodated in the locking grooves 255. As a result, a lower portion of the drawer case 110 may be fixed to the heating assembly 200, and the drawer case 110 may be restricted from forward and/or backward movement.

The drawer case 110 may include the second locking protrusions 116 protruding from the rear surface 110*b* of the drawer case 110. The upper frame 250 may include an interference portion 256 provided to correspond to the second locking protrusions 116. The interference portions 256 may be formed in the cover portion 252 of the upper frame 250. The interference portions 256 may be arranged to interfere with an upper side of the second locking protrusions 116. As a result, a rear portion of the drawer case 110 may be fixed to the heating assembly 200, and the drawer case 110 may be restricted from upward movement.

Referring to FIGS. 17 and 18, the drawer case 110 may include the third locking protrusions 117 protruding from the lower surface 110*a* of the drawer case 110. The third locking protrusions 117 may be arranged to be spaced rearwardly from the first locking protrusions 115. The third locking protrusions 117 may be disposed behind the body portion 251 of the upper frame 250. When the drawer case 110 is moved forward in a state in which the drawer case 110 and the heating assembly 200 are coupled, the third locking protrusions 117 may interfere with a rear portion of the first sealing protrusions 2571 of the upper frame 250. As a result, while the drawer case 110 is coupled to the heating assembly 200, the drawer case 110 may be restricted from the forward movement.

According to the present disclosure, the drawer case 110 may be easily disassembled and/or assembled into the heating assembly 200 without the need for a separate tool or jig. The user may couple the drawer case 110 to the heating assembly 200 or separate the drawer case 110 from the heating assembly 200 without a great deal of force or time. As a result, the user may form or remove the temperature control compartment 100 within the storage compartment 21 as desired. The user may or may not use the temperature control compartment 100 as desired. The ease of use of the refrigerator 1 may be improved.

Figure 19:
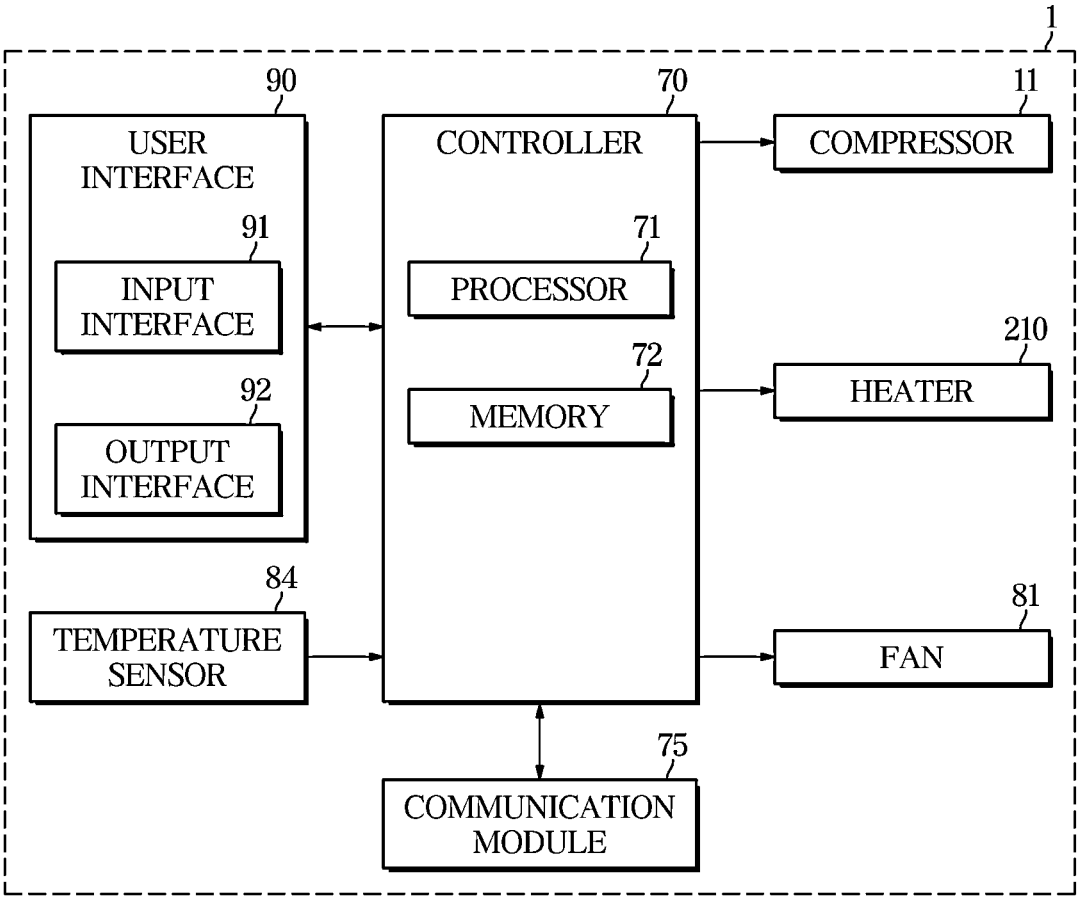
FIG. 19 is a control block diagram illustrating the refrigerator according to an embodiment.

FIG. 19 is a control block diagram illustrating the refrigerator according to an embodiment.

Referring to FIG. 19, the refrigerator 1 may include the controller 70. The refrigerator 1 may include a user interface 90. The refrigerator 1 may include a temperature sensor 84. The refrigerator 1 may include the compressor 11. The refrigerator 1 may include the heater 210. The refrigerator 1 may include the fan 81. The refrigerator 1 may include a communication module 75. However, any of the configurations of the refrigerator 1 shown in FIG. 19 may be omitted according to embodiments, and a configuration not shown in FIG. 19 may also be included according to embodiments.

The refrigerator 1 may include the user interface 90 for interacting with the user. The user interface 90 may receive instructions from the user. The user interface 90 may be configured to display various information about the refrigerator 1 to the user. For example, the user interface 90 may be implemented as a control panel. In the drawings, the user interface 90 is shown as being disposed on the right wall 43 of the inner case 40, but the present disclosure is not limited thereto. As long as the user interface 90 is provided in a location accessible to the user, there is no limitation on the location of the user interface 90.

The user interface 90 may include at least one input interface 91. The at least one input interface 91 may convert sensory information received from the user into an electrical signal. For example, the at least one input interface 91 may receive information associated with the temperature control compartment 100 (e.g., set temperature, set time, and the like) from the user. For example, the at least one input interface 91 may include buttons, switches, touch pads (touch screens), dials, and/or microphones. However, the present disclosure is not limited to the examples described above, and the user interface 90 may include any known input device for receiving user input.

The user interface 90 may include at least one output interface 92. The at least one output interface 92 may generate sensory information to transmit various data related to the operation, status, and the like of the refrigerator 1 to the user. For example, the at least one output interface 92 may communicate information related to the temperature control compartment 100 (e.g., current temperature, storage time, and the like) to the user. For example, the at least one output interface 92 may include a display, a speaker, or the like. However, the present disclosure is not limited to the examples described above, and the user interface 90 may include various known output devices for displaying various information about the refrigerator 1.

The refrigerator 1 may include the temperature sensor 84 configured to detect the internal temperature of the temperature control compartment 100. The temperature sensor 84 may detect the internal temperature of the temperature control compartment 100, output a signal, and transmit the output signal to the controller 70. In the drawings, the temperature sensor 84 is shown as being mounted on the fan case 82, but the present disclosure is not limited thereto. There is no limitation on the location of the temperature sensor 84, as long as the temperature sensor 84 is positioned to detect the internal temperature of the temperature control compartment 100. In addition, the temperature sensor 84 may not be provided as a configuration of the fan assembly 80.

The refrigerator 1 may include the communication module 75 for wired and/or wireless communication with external devices (e.g., servers, user devices, and the like). The communication module 75 may include at least one communication module. The communication module 75 may transmit data to or receive data from the external devices.

The refrigerator 1 may include the compressor 11. The compressor 11 may compress a refrigerant to high temperature and high pressure. The refrigerant compressed by the compressor 11 may be arranged to pass through a condenser (not shown). The compressor 11 may operate the cooling cycle of the refrigerator 1.

The refrigerator 1 may include the heater 210. The heater 210 may generate heat to heat the temperature control compartment 100.

The refrigerator 1 may include the fan 81. The fan 81 may circulate the air inside the storage compartment 21 to cool the temperature control compartment 100.

The refrigerator 1 may include the controller 70 that may control different configurations of the refrigerator 1. The refrigerator 1 may control the operation of the compressor 11. The controller 70 may control the operation of the heater 210. The controller 70 may control the operation of the fan 81.

The controller 70 may control the operation of the heater 210 and/or the fan 81 based on user commands received through the user interface 90. For example, the controller 70 may control the heating intensity, operating time, and the like of the heater 210 based on information received through the user interface 90. For example, the controller 70 may control the rotational speed, operating time, and the like of the fan 81 based on information received through the user interface 90. For example, the controller 70 may control the operation of the heater 210 and/or the fan 81 by comparing information received through the user interface 90 with information detected by the temperature sensor 84.

The controller 70 may include hardware, such as a CPU or memory, and software, such as a control program. For example, the controller 70 may include algorithms for controlling the operation of different configurations of the refrigerator 1, at least one memory 72 that stores data in the form of programs, and at least one processor 71 that performs the operations described above. The memory 72 and the processor 71 may each be implemented as separate chips. The processor 71 may include one or two or more processor chips, or may include one or two or more processing cores. The memory 72 may include one or two or more memory chips, or may include one or two or more memory blocks. Alternatively, the memory 72 and the processor 71 may be implemented as a single chip.

According to an embodiment, the refrigerator 1 may include the inner case 40 forming the storage compartment 20; the duct 60 configured to guide cold air into the storage compartment and facing the rear wall 42 of the inner case 40; the temperature control compartment 100 disposed within the storage compartment and configured to have a temperature independent of the storage compartment; and the heating assembly 200 configured to heat the temperature control compartment 100. The heating assembly 200 may include the heater 210; the connector 220 configured to supply power to the heater; and the heater case 230 configured to accommodate the heater 210. The connector 220 may be mountable on the duct so as to face the rear wall 42 of the inner case 40. The heater case 230 may be configured to cover the connector 220 mounted on the duct 60 to prevent and/or reduce moisture from entering the connector 220 mounted on the duct 60.

The heater case may be detachably couplable to the lower wall 41 of the inner case and the front side 60*a* of the duct.

The heater case may include the lower frame 240 configured to be seated on the lower wall of the inner case. The heater case may include the upper frame 250 detachably couplable to the lower frame.

The upper frame may include the body portion 251 configured to support the lower portion of the temperature control compartment. The upper frame may include the cover portion 252 extending upwardly from the rear side of the body portion to cover the connector mounted on the duct.

The heater may be attached to the upper inner surface 250*a* of the upper frame. The lower frame may include the protrusion 241 protruding upwardly and supporting the heater to prevent and/or reduce the heater from being separated from the upper inner surface of the upper frame.

The refrigerator may further include the guide rib 61 protruding from the front side of the duct. The guide rib 61 may be disposed above the connector mounted on the duct to guide moisture downward.

The guide rib 61 may have a shape inclined downwardly toward one side wall of the inner case 40.

The refrigerator may further include the drawer case 110 configured to form the temperature control compartment. The refrigerator may further include the drawer 120 configured to be inserted into or withdrawn from the drawer case.

The drawer case 110 may be detachably couplable to the heater case 230.

The refrigerator may include the drawer case 110 configured to form the temperature control compartment 100; and the drawer 120 configured to be inserted into or withdrawn from the drawer case. The drawer case may include the locking protrusion 115 protruding from the lower surface of the drawer case. The upper frame may include the locking groove 255 formed in the body portion to correspond to the locking protrusion.

The refrigerator may include the drawer case 110 configured to form the temperature control compartment 100; and the drawer 120 configured to be inserted into or withdrawn from the drawer case. The drawer case may include the locking protrusion 116 protruding from the rear surface of the drawer case. The upper frame may include the interference portion 256 formed on the cover portion and configured to interfere with the upper side of the locking protrusion.

The upper frame may include the first sealing protrusion 2571 protruding downwardly from the edge of the upper frame, the second sealing protrusion 2572 spaced apart from the first sealing protrusion and protruding downward, and the sealing groove 2673 formed between the first sealing protrusion and the second sealing protrusion. The lower frame may include the third sealing protrusion 242 protruding upwardly from the edge of the lower frame so as to be accommodated in the sealing groove.

The lower frame may include the hook 243 protruding from the third sealing protrusion. The upper frame may include the hook hole 258 formed in the first sealing protrusion and configured to correspond to the hook.

The duct may include the connector hole 62 into which the connector may be inserted.

The refrigerator may further include the controller 70 configured to control the operation of the heater. The connector may be electrically connected to the controller.

According to an embodiment, the refrigerator 1 may include the inner case 40 forming the storage compartment 20; the temperature control compartment 100 disposed within the storage compartment and configured to have a temperature independent of the storage compartment; and the heating assembly 200 configured to heat the lower portion of the temperature control compartment. The heating assembly 200 may include the upper frame 250; the heater 210 mounted on the upper inner surface of the upper frame; and the lower frame 240 detachably couplable to the upper frame. The lower frame 240 may include the protrusion 241 contactable with the heater to prevent and/or reduce the heater from being separated from the upper frame.

The heating assembly 200 may be separable from the storage compartment 20.

The heating assembly may include the connector 220 configured to supply power to the heater and facing the rear wall of the inner case. The upper frame may be configured to cover the connector.

The refrigerator may include the duct 60 disposed behind the temperature control compartment to guide cold air into the storage compartment. The duct 60 may include the connector hole 62 into which the connector may be inserted.

The upper frame may include the body portion 251 supporting the lower portion of the temperature control compartment and couplable to the lower wall 41 of the inner case. The upper frame may include the cover portion 252 extending upwardly from the rear side of the body portion to cover the connector and couplable to the front side 60*a* of the duct 60.

According to various embodiments of the present disclosure, the usability of the refrigerator may be improved.

According to various embodiments of the present disclosure, the safety of use of the refrigerator may be improved.

According to various embodiments of the present disclosure, the heating assembly may be easily coupled to or easily decoupled from the storage compartment.

According to various embodiments of the present disclosure, the drawer case may be easily coupled to or easily decoupled from the heating assembly.

According to various embodiments of the present disclosure, moisture may be prevented and/or reduced from entering the connector without the need for a separate gasket.

According to various embodiments of the present disclosure, the heating efficiency of the heater may be improved because the protrusion of the lower frame supports the heater.

The effects of the disclosure are not limited to those mentioned above, and other effects not mentioned will be apparent to those skilled in the art to which the disclosure belongs.

While the disclosure has been illustrated and described with reference to various example embodiments, it will be understood that the various example embodiments are intended to be illustrative, not limiting. It will also be understood by those skilled in the art that various changes in form and detail may be made without departing from the true spirit and full scope of the present disclosure, including the appended claims and their equivalents. It will also be understood that any of the embodiment(s) described herein may be used in conjunction with any other embodiment(s) described herein.

The invention claimed is:

1. A refrigerator comprising:

an inner case that forms a storage compartment;

a duct facing along a rear wall of the inner case and configured to guide cold air into the storage compartment;

a temperature control compartment within the storage compartment, the temperature control compartment to have a temperature independent of a temperature of the storage compartment; and a heating assembly configured to control the temperature of the temperature control compartment, the heating assembly including:

a heater, a connector configured to supply power to the heater and mountable on the duct so as to face the rear wall of the inner case, and a heater case accommodating the heater and configured to cover the connector mounted on the duct so that with the connector mounted on the duct, moisture which flows or condenses on the duct is prevented and/or reduced from entering the connector.

2. The refrigerator of claim 1, wherein the heater case is detachably couplable to a lower wall of the inner case and a front side of the duct.

3. The refrigerator of claim 1, wherein the heater case includes:

a lower frame configured to sit on the lower wall of the inner case, and an upper frame detachably couplable to the lower frame.

4. The refrigerator of claim 3, wherein the upper frame includes:

a body portion configured to support a lower portion of the temperature control compartment, and a cover portion extending upwardly from a rear side of the body portion so that with the connector mounted on the duct, the cover portion covers the connector.

5. The refrigerator of claim 3, wherein the heater is attached to an upper inner surface of the upper frame, and the lower frame includes a protrusion protruding upwardly and supporting the heater so that with the upper frame detachably coupled to the lower frame, the heater and the upper frame are in close contact.

6. The refrigerator of claim 1, further comprising a guide rib that protrudes from a front side of the duct, and with the connector mounted on the duct, the guide rib is above the connector to guide the moisture downward.

7. The refrigerator of claim 6, wherein the guide rib is inclined downwardly toward a side wall of the inner case.

8. The refrigerator of claim 1, further comprising:

a drawer case to form the temperature control compartment, and a drawer configured to be inserted into and withdrawn from the drawer case.

9. The refrigerator of claim 8, wherein the drawer case is detachably couplable to the heater case.

10. The refrigerator of claim 4, further comprising a drawer case to form the temperature control compartment and a drawer configured to be inserted into and withdrawn from the drawer case, and wherein the drawer case includes a locking protrusion protruding from a lower surface of the drawer case, and the upper frame includes a locking groove in the body portion to correspond to the locking protrusion so that with the drawer inserted into the drawer case, the locking protrusion is accommodated in the locking groove and movement of the drawer in at least one of a forward direction and a backward direction is restricted.

11. The refrigerator of claim 4, further comprising a drawer case to form the temperature control compartment and a drawer configured to be inserted into and withdrawn from the drawer case, and wherein the drawer case includes a locking protrusion protruding from a rear surface of the drawer case, and the upper frame includes an interference portion on the cover portion that is configured to interfere with an upper side of the locking protrusion so that with the drawer inserted into the drawer case, the interference portion interferes with the upper side of the locking protrusion and an upward movement of the drawer case is restricted.

12. The refrigerator of claim 3, wherein the upper frame includes:

a first sealing protrusion protruding downwardly from an edge of the upper frame, a second sealing protrusion spaced apart from the first sealing protrusion and protruding downwardly from a body portion of the upper frame so that a sealing groove is formed between the first sealing protrusion and the second sealing protrusion, and the lower frame includes:

a third sealing protrusion protruding upwardly from an edge of the lower frame so that with the upper frame detachably coupled to the lower frame, the third sealing protrusion is accommodated in the sealing groove.

13. The refrigerator of claim 12, wherein the lower frame includes a hook protruding from the third sealing protrusion, and the upper frame includes a hook hole formed in the first sealing protrusion and configured to correspond to the hook so that with the upper frame detachably coupled to the lower frame, the hook is inserted into the hook hole.

14. The refrigerator of claim 1, wherein the duct includes a connector hole so that with the connector mounted on the duct, the connector is insertable into the connector hole.

15. The refrigerator of claim 1, further comprises a controller configured to control an operation of the heater, wherein, with the connector mounted on the duct, the connector is electrically connected to the controller.

* * * * *